US008957312B2

(12) United States Patent
McCullough et al.

(10) Patent No.: US 8,957,312 B2
(45) Date of Patent: Feb. 17, 2015

(54) SUBMERSIBLE COMPOSITE CABLE AND METHODS

(75) Inventors: Colin McCullough, Chanhassen, MN (US); Douglas E. Johnson, Minneapolis, MN (US); Michael F. Grether, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 338 days.

(21) Appl. No.: 13/382,591

(22) PCT Filed: Jun. 30, 2010

(86) PCT No.: PCT/US2010/040517

§ 371 (c)(1), (2), (4) Date: Mar. 16, 2012

(87) PCT Pub. No.: WO2011/008568

PCT Pub. Date: Jan. 20, 2011

(65) Prior Publication Data

US 2012/0168199 A1 Jul. 5, 2012

Related U.S. Application Data

(60) Provisional application No. 61/226,056, filed on Jul. 16, 2009, provisional application No. 61/226,151, filed on Jul. 16, 2009.

(51) Int. Cl.

| | |
|---|---|
| ***H01B 7/14*** | (2006.01) |
| ***H01B 7/04*** | (2006.01) |
| *H01B 7/18* | (2006.01) |

(52) U.S. Cl.

CPC ..... *H01B 7/14* (2013.01); *H01B 7/045* (2013.01); *H01B 7/182* (2013.01)

USPC ..... 174/113 R; 174/47; 174/126.4; 174/126.2

(58) Field of Classification Search

USPC ..... 174/47, 102 R, 103, 105 R, 106 R, 107, 174/108, 110 R, 113 R, 113 C, 115, 116, 174/119 R, 119 C, 126.2, 128.1, 128.2

See application file for complete search history.

(56) References Cited

U.S. PATENT DOCUMENTS

| | | | |
|---|---|---|---|
| 1,793,293 | A | 2/1931 | Varney |
| 3,429,722 | A | 2/1969 | Economy |

(Continued)

FOREIGN PATENT DOCUMENTS

| | | |
|---|---|---|
| CN | 2147625 | 11/1993 |
| CN | 1446267 | 10/2003 |

(Continued)

OTHER PUBLICATIONS

Wikipedia, "wire rope", Sep. 1, 2009.*

*Primary Examiner* — Hoa C Nguyen
*Assistant Examiner* — Amol Patel
(74) *Attorney, Agent, or Firm* — Adam Bramwell

(57) ABSTRACT

Embodiments of submersible composite cables include a non-composite electrically conductive core cable, a multiplicity of composite cables, including a multiplicity of composite wires, around the core cable, and an insulative sheath surrounding the composite cables. Other embodiments include an electrically conductive core cable; a multiplicity of elements selected from fluid transport, electrical power transmission, electrical signal transmission, light transmission, weight elements, buoyancy elements, filler elements, or armor elements, arranged around the core cable in at least one cylindrical layer defined about a center longitudinal axis of the core cable when viewed in a radial cross section; a multiplicity of composite wires surrounding the elements in at least one cylindrical layer about the center longitudinal axis; and an insulative sheath surrounding the composite wires. The composite wires may be metal matrix or polymer composite wires. Methods of making and using submersible composite cables are also disclosed.

19 Claims, 8 Drawing Sheets

(56) References Cited

U.S. PATENT DOCUMENTS

| | | | | |
|---|---|---|---|---|
| 3,717,720 | A | 2/1973 | Snellman | |
| 3,795,524 | A | 3/1974 | Sowman | |
| 4,047,965 | A | 9/1977 | Karst | |
| 4,345,112 | A | 8/1982 | Sugata et al. | |
| 4,954,462 | A | 9/1990 | Wood | |
| 5,015,958 | A | 5/1991 | Masia et al. | |
| 5,112,882 | A | 5/1992 | Babu | |
| 5,171,942 | A | 12/1992 | Powers | |
| 5,185,299 | A | 2/1993 | Wood | |
| 5,230,033 | A | 7/1993 | Soodak | |
| 5,362,921 | A * | 11/1994 | Birkelund et al. | 174/47 |
| 5,554,826 | A | 9/1996 | Gentry | |
| 5,780,154 | A | 7/1998 | Okano | |
| 6,180,232 | B1 | 1/2001 | McCullough | |
| 6,245,425 | B1 | 6/2001 | McCullough | |
| 6,247,359 | B1 | 6/2001 | De Angelis | |
| 6,329,056 | B1 * | 12/2001 | Deve et al. | 428/389 |
| 6,336,495 | B1 | 1/2002 | McCullough | |
| 6,344,270 | B1 | 2/2002 | McCullough | |
| 6,447,927 | B1 | 9/2002 | McCullough | |
| 6,460,597 | B1 | 10/2002 | McCullough | |
| 6,485,796 | B1 | 11/2002 | Carpenter et al. | |
| 6,544,645 | B1 | 4/2003 | McCullough | |
| 6,559,385 | B1 | 5/2003 | Johnson | |
| 6,692,842 | B2 | 2/2004 | McCullough | |
| 6,723,451 | B1 | 4/2004 | McCullough | |
| 6,747,213 | B2 | 6/2004 | Bonicel | |
| 6,796,365 | B1 | 9/2004 | McCullough | |
| 7,093,416 | B2 | 8/2006 | Johnson | |
| 7,131,308 | B2 | 11/2006 | McCullough et al. | |
| 7,239,781 | B2 * | 7/2007 | Chartier et al. | 385/103 |
| 7,417,187 | B2 * | 8/2008 | Tanaka et al. | 174/47 |
| 7,462,781 | B2 | 12/2008 | Varkey et al. | |
| 7,473,844 | B2 * | 1/2009 | Figenschou et al. | 174/47 |
| 7,754,966 | B2 * | 7/2010 | Figenschou | 174/47 |
| 7,763,802 | B2 * | 7/2010 | Varkey et al. | 174/106 R |
| 8,186,911 | B2 * | 5/2012 | Figenschou | 405/169 |
| 8,212,148 | B1 | 7/2012 | Lenges et al. | |
| 8,304,651 | B2 * | 11/2012 | Figenschou et al. | 174/47 |
| 2002/0027012 | A1 | 3/2002 | Bonicel | |
| 2003/0124377 | A1 | 7/2003 | McCullough et al. | |
| 2003/0194916 | A1 | 10/2003 | Quesnel | |
| 2004/0185290 | A1 | 9/2004 | McCullough | |
| 2006/0102377 | A1 | 5/2006 | Johnson | |
| 2006/0137880 | A1 | 6/2006 | Figenschou et al. | |
| 2006/0141252 | A1 * | 6/2006 | Chartier et al. | 428/375 |
| 2006/0193572 | A1 * | 8/2006 | Mjelstad | 385/101 |
| 2006/0231286 | A1 | 10/2006 | Varkey | |
| 2007/0000682 | A1 | 1/2007 | Varkey et al. | |
| 2007/0044991 | A1 | 3/2007 | Varkey | |
| 2007/0044992 | A1 | 3/2007 | Bremnes | |
| 2007/0044993 | A1 | 3/2007 | Varkey | |
| 2007/0205009 | A1 | 9/2007 | Figenschou | |
| 2007/0237469 | A1 | 10/2007 | Espen | |
| 2007/0253778 | A1 * | 11/2007 | Figenschou | 405/169 |
| 2007/0271897 | A1 | 11/2007 | Hanna et al. | |
| 2008/0081721 | A1 | 4/2008 | Bissig | |
| 2009/0120663 | A1 * | 5/2009 | Karlsen et al. | 174/113 R |
| 2010/0038112 | A1 | 2/2010 | Grether | |
| 2010/0054677 | A1 * | 3/2010 | Figenschou et al. | 385/101 |
| 2011/0005795 | A1 * | 1/2011 | Deighton et al. | 174/47 |
| 2011/0074380 | A1 | 3/2011 | Jeon | |
| 2012/0024565 | A1 | 2/2012 | Orini | |

FOREIGN PATENT DOCUMENTS

| | | |
|---|---|---|
| GB | 750703 | 6/1956 |
| JP | 4-32109 | 2/1992 |
| JP | 11-66978 | 3/1999 |
| JP | 2001-210153 | 8/2001 |
| JP | 2007-521968 | 8/2007 |
| JP | 2008-503051 | 1/2008 |
| JP | 2008-504469 | 2/2008 |
| WO | WO 02/06550 | 1/2002 |
| WO | WO 2005/082556 | 9/2005 |
| WO | WO 2005/124095 | 12/2005 |
| WO | WO 2005/124213 | 12/2005 |
| WO | WO 2011/008620 | 1/2011 |
| WO | WO 2011/094146 | 8/2011 |
| WO | WO 2011/103036 | 8/2011 |

* cited by examiner

SUBMERSIBLE COMPOSITE CABLE AND METHODS

CROSS REFERENCE TO RELATED APPLICATIONS

This application is a national stage filing under 35 U.S.C. 371 of PCT/US2010/040517, filed Jun. 30, 2010, which claims priority to U.S. Provisional Application Nos. 61/226,056, filed Jul. 16, 2009, and 61/226,151, filed Jul. 16, 2009, the disclosure of which is incorporated by reference in its/their entirety herein.

TECHNICAL FIELD

The present disclosure relates generally to submersible composite cables and their method of manufacture and use. The disclosure further relates to submersible composite cables useful as underwater umbilicals or tethers.

BACKGROUND

Undersea cables are used to transmit electrical power and signals to great depths for numerous undersea applications including offshore oil wellheads, robotic vehicle operation, submarine power transfer and fiber optic cables. Submersible cables for underwater transmission of electrical power are known, for example, U.S. Pat. No. 4,345,112 (Sugata et al.), and U.S. Pat. App. Pub. No. 2007/0044992 (Bremnes). Such submersible power transmission cables generally include conducting elements and load bearing elements that are generally required to be able to fully withstand, without breaking, their drawing-out and winding-up by a capstan as the cable is deployed and retrieved from a vessel at the sea surface or underwater. Greater working depths are generally desired; however, the maximum working depth of a cable is generally limited by the maximum load and strain the cable can withstand under its own weight. The maximum depth and power transfer capability is thus limited by the material properties of the conducting elements and load bearing elements.

Submersible power transmission cables are normally manufactured using metal (e.g., steel, copper, aluminum) conductor wires and/or load bearing elements, and generally have substantial transverse cross sections, thereby providing the cable with considerable added weight due to the high specific gravity of metals, and copper in particular. Furthermore, because copper wires generally have a poor load bearing capacity, the water depth at which submersible power transmission cables incorporating copper conductors can be used is somewhat limited. Various cable designs have been proposed to achieve the high tensile strength and break resistance needed to successfully deploy underwater cables over long distances and depths (e.g., lengths of 1,000 meters or longer), as exemplified by U.S. Pat. App. Pub. Nos. 2007/0271897 (Hanna et al.); 2007/0237469 (Espen); and U.S. Pat. App. Pub. Nos. 2006/0137880, 2007/0205009, and 2007/0253778 (all Figenschou). For some deep water applications, unarmored cables have been constructed using, for example, KEVLAR and copper. Nevertheless, a lightweight, high tensile strength power umbilical or tether capable of transmitting large quantities of electrical power, fluids and electric current/signals between equipment located at the sea surface and equipment located on the sea bed, particularly in deep waters, continues to be sought.

SUMMARY

In some applications, it is desirable to further improve the construction of submersible power transmission cables and their method of manufacture and use. In certain applications, it is desirable to improve the physical properties of submersible power transmission cables, for example, their weight, tensile strength and elongation to failure. In other applications, it is desirable to improve the reliability and reduce the cost of submersible power transmission cables.

Thus, in one aspect, the present disclosure provides a submersible composite cable comprising a non-composite electrically conductive core cable; a plurality of composite cables around the core cable, wherein the composite cables comprise a plurality of composite wires; and an insulative sheath surrounding the plurality of composite cables. In some exemplary embodiments, the submersible composite cable further comprises a second plurality of composite wires, wherein at least a portion of the second plurality of composite wires is arranged around the plurality of composite cables in at least one cylindrical layer defined about a center longitudinal axis of the core cable when viewed in a radial cross section. In certain presently preferred embodiments, the submersible composite cable exhibits a strain to break limit of at least 0.5%.

In some exemplary embodiments, the submersible composite cable comprises at least one element selected from a fluid transport element, an electrical power transmission element, an electrical signal transmission element, a light transmission element, a weight element, a buoyancy element, a filler element, or an armor element. In certain exemplary embodiments, the light transmission element comprises at least one optical fiber. In additional exemplary embodiments, the armor element comprises a plurality of fibers surrounding the core cable, wherein the fibers are selected from the group consisting of poly(aramid) fibers, ceramic fibers, carbon fibers, metal fibers, glass fibers, and combinations thereof. In further exemplary embodiments, the submersible composite cable comprises a plurality of wires surrounding the core cable, wherein the wires are selected from metal wires, metal matrix composite wires, and combinations thereof.

In other exemplary embodiments, the core cable comprises at least one metal wire, one metal load carrying element, or a combination thereof. In further exemplary embodiments, the core cable comprises a plurality of metal wires. In additional exemplary embodiments, the core cable is stranded. In certain particular exemplary embodiments, the stranded core cable is helically stranded.

In additional exemplary embodiments, the plurality of composite cables around the core cable is arranged in at least two cylindrical layers defined about a center longitudinal axis of the core cable when viewed in a radial cross section. In certain additional exemplary embodiments, at least one of the at least two cylindrical layers comprises only the composite cables. In other additional exemplary embodiments, at least one of the at least two cylindrical layers further comprises at least one element selected from the group consisting of a fluid transport element, a power transmission element, a light transmission element, a weight element, a filler element, or an armor element.

In some particular additional exemplary embodiments, at least one of the composite cables is a stranded composite cable comprising a plurality of cylindrical layers of the composite wires stranded about a center longitudinal axis of the at least one composite cable when viewed in a radial cross section. In certain exemplary embodiments, the at least one stranded composite cable is helically stranded. In other exemplary embodiments, each of the composite wires is selected from the group consisting of a metal matrix composite wire and a polymer composite wire. In further exemplary embodiments, the insulative sheath forms an outer surface of the submersible composite cable. In some exemplary embodiments, the insulative sheath comprises a material selected from the group consisting of a ceramic, a glass, a (co)polymer, and combinations thereof.

In another aspect, the present disclosure provides a method of making a submersible composite cable as described above, comprising (a) providing a non-composite electrically conductive core cable; (b) arranging a plurality of composite cables around the core cable, wherein the composite cables comprise a plurality of composite wires; and (c) surrounding the plurality of composite cables with an insulative sheath.

In an additional aspect, the present disclosure provides a submersible composite cable, comprising an electrically conductive core cable; a plurality of elements arranged around the core cable in at least one cylindrical layer defined about a center longitudinal axis of the core cable when viewed in a radial cross section, wherein each element is selected from the group consisting of a fluid transport element, an electrical power transmission element, an electrical signal transmission element, a light transmission element, a weight element, a buoyancy element, a filler element, or an armor element; a plurality of composite wires surrounding the plurality of elements in at least one cylindrical layer about the center longitudinal axis of the core cable; and an insulative sheath surrounding the plurality of composite wires. In some exemplary embodiments, at least a portion of the plurality of composite wires is stranded to form at least one composite cable.

In certain exemplary embodiments, the armor element comprises a plurality of fibers surrounding the core cable, wherein the fibers are selected from the group consisting of poly(aramid) fibers, ceramic fibers, carbon fibers, metal fibers, glass fibers, and combinations thereof. In other exemplary embodiments, the armor element comprises a plurality of wires surrounding the core cable, wherein the wires are selected from the group consisting of metal wires, metal matrix composite wires, and combinations thereof. In additional exemplary embodiments, the submersible composite cable further comprises a second insulative sheath, wherein the second insulative sheath is positioned between the plurality of elements and the plurality of composite wires, and wherein the second insulative sheath surrounds the plurality of elements.

In yet another aspect, the present disclosure provides a method of making a submersible composite cable as described above, comprising (a) providing an electrically conductive core cable; (b) arranging a plurality of elements around the core cable in at least one cylindrical layer defined about a center longitudinal axis of the core cable when viewed in a radial cross section, wherein each element is selected from the group consisting of a fluid transport element, an electrical power transmission element, an electrical signal transmission element, a light transmission element, a weight element, a buoyancy element, a filler element, or an armor element; (c) surrounding the plurality of elements with a plurality of composite wires arranged in at least one cylindrical layer about the center longitudinal axis of the core cable; and (d) surrounding the plurality of composite wires with an insulative sheath.

Exemplary embodiments of submersible composite cables according to the present disclosure may have various features and characteristics that enable their use and provide advantages in a variety of applications. Submersible composite cables according to some exemplary embodiments of the present disclosure may exhibit improved performance due to improved material properties including, low density, high modulus, high strength, fatigue resistance and conductivity. Thus, exemplary submersible composite cables according to the present disclosure may exhibit greatly increased maximum working depth, maximum working load, and breaking strength, with greater or at least comparable electrical power transfer capabilities, compared to existing non-composite cables. Furthermore, exemplary embodiments of submersible composite cables according to the present disclosure may be lighter in weight in seawater compared to non-composite submersible cables, and therefore more readily deployed to, and recovered from, the seabed. The fatigue resistance of the submersible composite cables may also be improved relative to non-composite cables.

Various aspects and advantages of exemplary embodiments of the disclosure have been summarized. The above Summary is not intended to describe each illustrated embodiment or every implementation of the present certain exemplary embodiments of the present disclosure. The Drawings and the Detailed Description that follow more particularly exemplify certain preferred embodiments using the principles disclosed herein.

BRIEF DESCRIPTION OF DRAWINGS

Exemplary embodiments of the present disclosure are further described with reference to the appended figures, wherein.

DETAILED DESCRIPTION

Figure 1A:
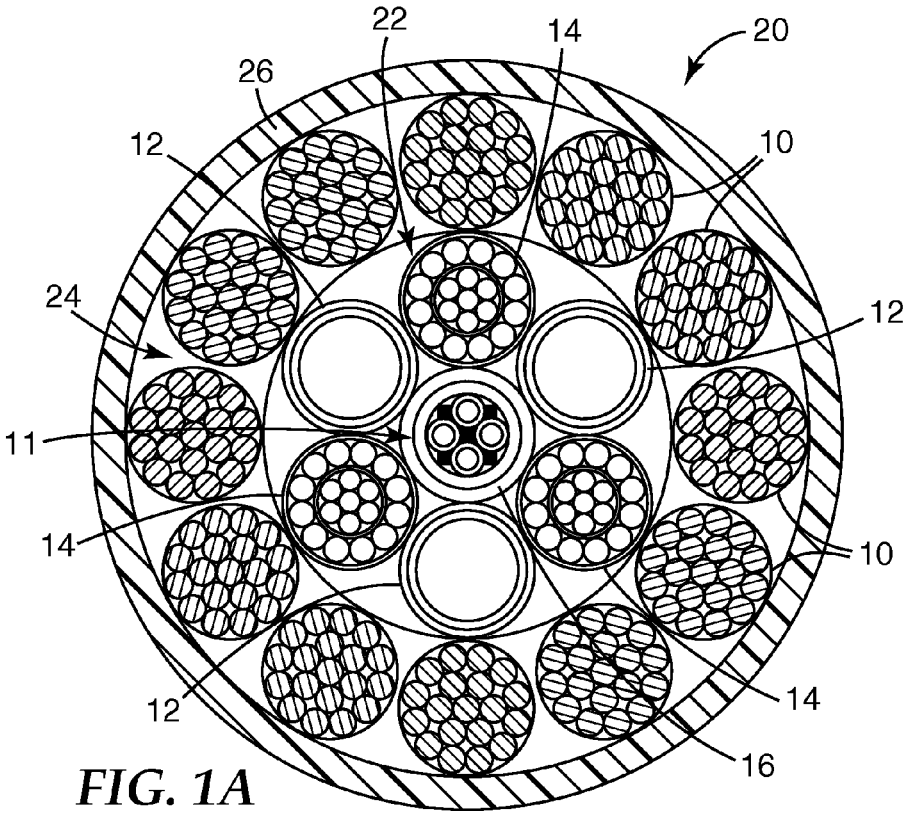
FIGS. 1A-1C are cross-sectional end views of exemplary submersible composite power cables according to exemplary embodiments of the present disclosure.

Certain terms are used throughout the description and the claims that, while for the most part are well known, may require some explanation. It should understood that, as used herein, when referring to a "wire" as being "brittle", this means that the wire will fracture under tensile loading with minimal plastic deformation.

The term "wire" is used generically to include ductile metal wires, metal matrix composite wires, polymer matrix composite wires, optical fiber wires, and hollow tubular wires for fluid transport.

The term "ductile" when used to refer to the deformation of a wire, means that the wire would substantially undergo plastic deformation during bending without fracture or breakage.

The term "bend" or "bending" when used to refer to the deformation of a wire includes two dimensional and/or three dimensional bend deformation, such as bending the wire helically during stranding. When referring to a wire as having bend deformation, this does not exclude the possibility that the wire also has deformation resulting from tensile and/or torsional forces.

"Significant elastic bend" deformation means bend deformation which occurs when the wire is bent to a radius of curvature up to 10,000 times the radius of the wire. As applied to a circular cross section wire, this significant elastic bend deformation would impart a strain at the outer fiber of the wire of at least 0.01%.

The term "composite wire" refers to a wire formed from a combination of materials differing in composition or form which are bound together, and which exhibit brittle or non-ductile behavior.

The term "non-composite electrically conductive core cable" means a cable, which may comprise a single wire or multiple wires which are not composite wires, wherein the wires are capable of conducting an electrical current, and are formed at the center of a tether or umbilical cable.

The term "metal matrix composite wire" refers to a composite wire comprising one or more reinforcing materials bound into a matrix consisting of one or more ductile metal phases.

The term "polymer matrix composite wire" similarly refers to a composite wire comprising one or more reinforcing materials bound into a matrix consisting of one or more polymeric phases.

The term "ceramic" means glass, crystalline ceramic, glass-ceramic, and combinations thereof.

The term "polycrystalline" means a material having predominantly a plurality of crystalline grains in which the grain size is less than the diameter of the fiber in which the grains are present.

The terms "cabling" and "stranding" are used interchangeably, as are "cabled" and "stranded".

The term "lay" describes the manner in which the wires in a stranded layer of a helically stranded cable are wound into a helix.

The term "lay direction" refers to the stranding direction of the wire strands in a helically stranded layer. To determine the lay direction of a helically stranded layer, a viewer looks at the surface of the helically stranded wire layer as the cable points away from the viewer. If the wire strands appear to turn in a clockwise direction as the strands progress away from the viewer, then the cable is referred to as having a "right hand lay". If the wire strands appear to turn in a counter-clockwise direction as the strands progress away from the viewer, then the cable is referred to as having a "left hand lay".

The terms "center axis" and "center longitudinal axis" are used interchangeably to denote a common longitudinal axis positioned radially at the center of a multilayer helically stranded cable.

The term "lay angle" refers to the angle, formed by a stranded wire, relative to the center longitudinal axis of a helically stranded cable.

The term "crossing angle" means the relative (absolute) difference between the lay angles of adjacent wire layers of a helically stranded wire cable.

The term "lay length" refers to the length of the stranded cable in which a single wire in a helically stranded layer completes one full helical revolution about the center longitudinal axis of a helically stranded cable.

The term "continuous fiber" means a fiber having a length that is relatively infinite when compared to the average fiber diameter. Typically, this means that the fiber has an aspect ratio (i.e., ratio of the length of the fiber to the average diameter of the fiber) of at least $1\times10^5$ (in some embodiments, at least $1\times10^6$, or even at least $1\times10^7$). Typically, such fibers have a length on the order of at least about 15 cm to at least several meters, and may even have lengths on the order of kilometers or more.

The present disclosure relates to submersible composite cables. Submersible composite cables may be used in various applications, for example, as underwater tethers or umbilicals for transmitting electrical power, power and information from the surface to an undersea base and remotely operated vehicle cables which are contained within the base. Other uses include use as intervention cables and risers for transmitting fluids to and from off-shore oil and gas wells. Still other uses are as underground or overhead electrical power transmission cables for use in wet environments, for example, swamps, rain forests, and the like. Exemplary underground or overhead electrical power transmission cables and applications are described in co-pending U.S. Prov. Pat. App. Ser. No. 61/226,151, titled "INSULATED COMPOSITE POWER CABLE AND METHOD OF MAKING AND USING," filed Jul. 16, 2009.

Composite materials offer improved performance enabling greater depths and increased power transfer. Typically umbilical or tether cables are designed for specific depths (e.g., 3,000 m typical depth). Cables are desirable which would extend depths to 6,000 m or greater. Laying or extending cables to depths of 3,000 m or more can be very difficult without breaking the cable. Low density, higher modulus composite materials are desired to provide a lightweight, high load bearing capability at low strain.

Another important consideration for submersible power cables is weight of the cable per unit length in seawater. The weight and strength of a cable determines the depth to which the cable may be laid or extended without exceeding its mechanical load limit (i.e. breaking strength) under its own weight. In addition, it may be necessary to raise the cable to the surface of the sea to effect repairs, which would necessarily require hauling up a large weight of cable, likely requiring use of a powerful winch and a large support vessel. The fatigue resistance of the submersible cables may also be important. Umbilical cables are hoisted frequently over a life time of five years, generally passing through a series of sheaves each time the cable is hoisted. This creates very high tensile and bending loads at the sheaves where tension is at a maximum due to their supporting entire cable weight. Additional dynamic bending loads may occur from vertical and horizontal bobbing of the platform due to ocean waves. Composite cables may thus provide for improved fatigue resistance of submersible power transmission cables.

Various exemplary embodiments of the disclosure will now be described with particular reference to the Drawings. Exemplary embodiments of the present disclosure may take on various modifications and alterations without departing from the spirit and scope of the disclosure. Accordingly, it is to be understood that the embodiments of the present disclosure are not to be limited to the following described exemplary embodiments, but are to be controlled by the limitations set forth in the claims and any equivalents thereof.

Referring now to FIG. 1A, in one aspect, the present disclosure provides a submersible composite cable 20 comprising an electrically conductive non-composite load bearing conductor cable 16 at the core 11 of submersible composite cable 20; a plurality of composite cables 10 arranged about the core 11, wherein the composite cables 10 comprise a plurality of composite wires; and an insulative sheath 26 surrounding the plurality of composite cables 10.

In some exemplary embodiments illustrated by FIG. 1A, at least two cylindrical layers are formed around core 11; a first cylindrical layer 22 formed about the electrically conductive non-composite cable 14, and a second cylindrical layer 24 comprising the plurality of composite cables 10 formed about the first cylindrical layer 22. In the particular embodiment illustrated by FIG. 1A, the core 11 comprises a load bearing conductor cable 16; and the first cylindrical layer 22 optionally comprises a plurality of electrically conductive non-composite cables 14, which may be conductors and/or load bearing elements, as well as other optional elements 12, which may be selected from fluid transport elements, electrical power transmission elements, electrical signal transmission elements, light transmission elements, weight elements, buoyancy elements, filler elements, or armor elements. In the particular exemplary embodiment illustrated by FIG. 1A, at least one (in this case, cylindrical layer 24) of the at least two cylindrical layers (22 and 24) comprises only the plurality of composite cables 10.

Although FIG. 1A illustrates a particular embodiment with a particular core 11 and a particular arrangement of composite cables 10, optional additional electrically conductive non-composite cables 14 and/or elements 12 used to form each of at least two cylindrical layers about the core, it will be understood that other embodiments with other arrangements are possible.

Figure 1B:
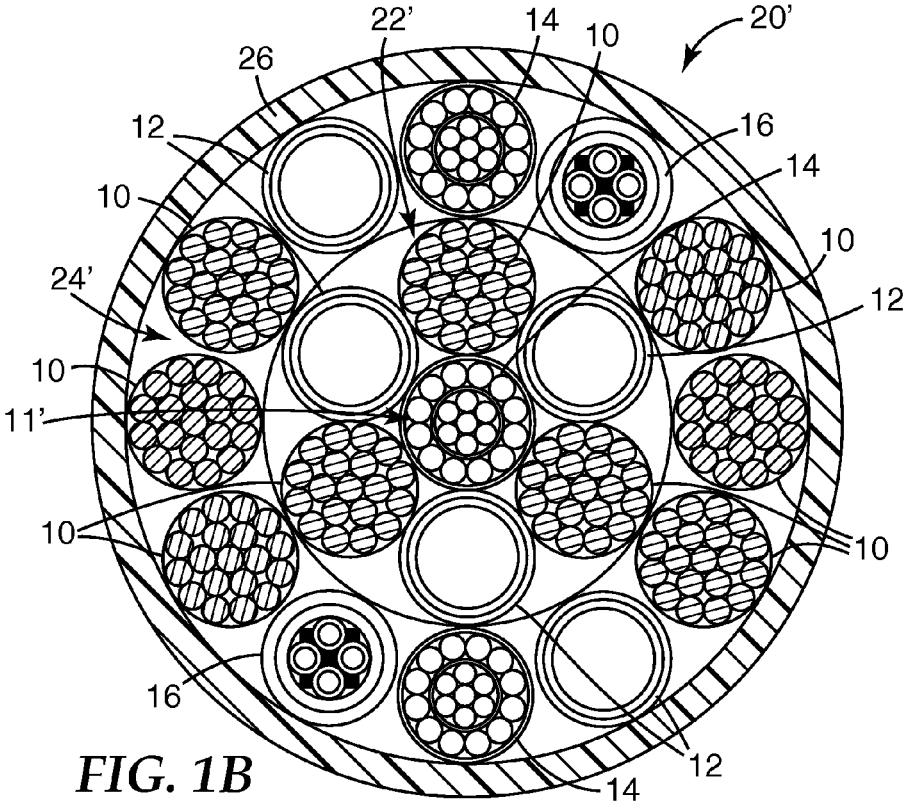

Thus, for example, with particular reference to FIG. 1B, the present disclosure also provides a submersible composite cable 20' comprising non-composite electrically conductive multi-wire cable 14 at the core 11" of submersible composite cable 20'; a plurality of composite cables 10 around the core 11', wherein the composite cables 10 comprise a plurality of composite wires; and an insulative sheath 26 surrounding the plurality of composite cables 10. In the particular embodiment illustrated by FIG. 1B, the core 11' comprises an electrically conductive non-composite cable 14, and the plurality of composite cables 10 is arranged symmetrically around the core 11' in at least two cylindrical layers, first (inner) cylindrical layer 22', and second (outer) cylindrical layer 24', defined about a center longitudinal axis of the core 11' when viewed in radial cross section.

In the particular embodiment illustrated by FIG. 1B, each of the at least two cylindrical layers 22' and 24' additionally comprise other optional elements 12, which may be selected from fluid transport elements, electrical power transmission elements, electrical signal transmission elements, light transmission elements, weight elements, buoyancy elements, filler elements, or armor elements. Any of the optional elements may preferably be composite reinforced elements, for example, elements reinforced with metal matrix and/or polymer matrix composite wires, rods, tubes, layers, and the like. As shown in FIG. 1B, the plurality of composite cables 10 need not completely form either one or both of the at least two cylindrical layers 22' and 24', and composite cables 10 may be combined in a layer with one or more optional non-composite electrically conductive cables 14 and/or optional elements 12.

Figure 1C:
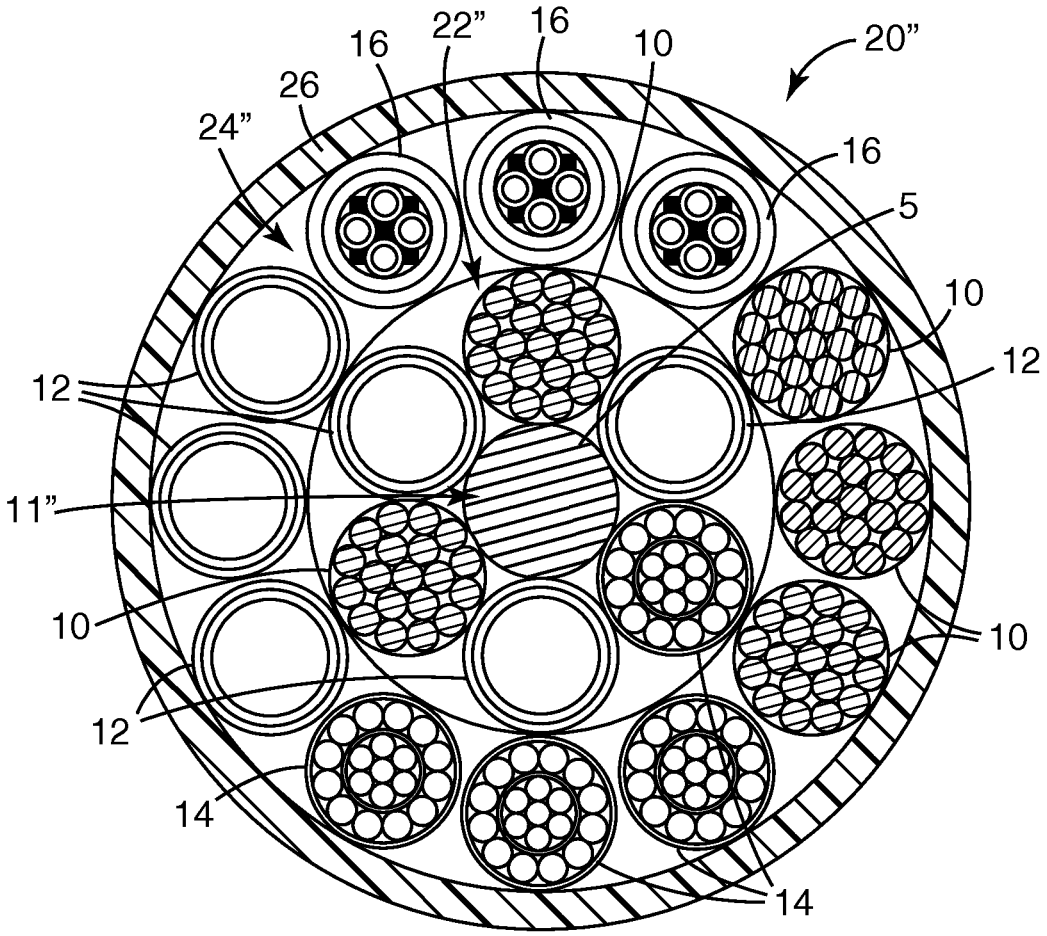

In other exemplary embodiments illustrated by FIG. 1C, the present disclosure also provides a submersible composite cable 20" comprising non-composite electrically conductive single wire cable 5 at the core 11" of submersible composite cable 20"; a plurality of composite cables 10 around the core 11", wherein the composite cables 10 comprise a plurality of composite wires; and an insulative sheath 26 surrounding the plurality of composite cables 10. In the particular embodiment illustrated by FIG. 1C, the core 11" comprises a non-composite electrically conductive single wire cable 5, and the plurality of composite cables 10 is arranged asymmetrically about the core 11" in at least two cylindrical layers, first (inner) cylindrical layer 22", and second (outer) cylindrical layer 24", defined about a center longitudinal axis of the core 11" when viewed in radial cross section.

In the particular embodiment illustrated by FIG. 1C, each of the at least two cylindrical layers 22" and 24" additionally comprise other optional elements 12, which may be selected from fluid transport elements, electrical power transmission elements, electrical signal transmission elements, light transmission elements, weight elements, buoyancy elements, filler elements, or armor elements. As shown in FIG. 1C, the plurality of composite cables 10 need not completely form either one or both of the at least two cylindrical layers 22" and 24", and composite cables 10 may be combined in a layer with one or more optional non-composite electrically conductive cables 14 and/or optional elements 12.

In other additional exemplary embodiments, at least one of the at least two cylindrical layers further comprises at least one element selected from the group consisting of a fluid transport element, a power transmission element, a light transmission element, a weight element, a filler element, or an armor element. Thus, as illustrated by FIGS. 1A-1C, the submersible composite cable may optionally comprise at least one element 12 selected from a fluid transport element, an electrical power transmission element, an electrical signal transmission element, a light transmission element, a weight element, a buoyancy element, a filler element, or an armor element. In certain exemplary embodiments, the light transmission element comprises at least one optical fiber. Furthermore, as shown in the particular exemplary embodiments illustrated by FIGS. 1A-1C, the core (11, 11', or 11") comprises a non-composite electrically conductive cable, which may be selected from at single metal wire cable 5, a multi-wire metal cable 14, or a combination 16 of metal wires and metal load bearing elements.

In further exemplary embodiments, the submersible composite cable further comprises a second plurality of composite wires, wherein at least a portion of the second plurality of composite wires is arranged around the plurality of composite cables in at least one cylindrical layer defined about a center longitudinal axis of the core cable when viewed in a radial cross section. In some exemplary embodiments illustrated by FIGS. 1B-1C, the second plurality of composite wires may be provided in the form of one or more additional composite cables 10. In some particular exemplary embodiments illustrated by FIG. 1B, the second plurality of composite wires comprises a plurality of composite cables 10 arranged symmetrically about core 11' and first cylindrical layer 22', forming, with optional non-composite electrically conductive cables 14 and/or optional elements 12, second cylindrical layer 24'. In additional particular exemplary embodiments illustrated by FIG. 1C, the second plurality of composite wires comprises a plurality of composite cables 10 arranged asymmetrically about core 11" and first cylindrical layer 22", forming, with optional non-composite electrically conductive cables 14 and/or optional elements 12, second cylindrical layer 24".

Furthermore, in some exemplary embodiments, the present disclosure provides submersible composite cable (e.g., 20, 20', 20") comprising one or more composite cables 10, which include a plurality of stranded composite wires, which may be stranded and more preferably helically stranded. The composite wires may be non-ductile, and thus may not be sufficiently deformed during conventional cable stranding processes in such a way as to maintain their helical arrangement. Therefore, the present disclosure provides, in certain embodiments, a higher tensile strength stranded composite cable, and further, provides, in some embodiments, a means for maintaining the helical arrangement of the wires in the stranded cable. In this way, the stranded cable may be conveniently provided as an intermediate article or as a final article. When used as an intermediate article, the stranded composite cable may be later incorporated into a final article such as an electrical power transmission cable, for example, a submersible electrical power transmission cable, or a fluid transmission cable, for example, an intervention cable.

Thus, FIGS. 2A-2D illustrate cross-sectional end views of exemplary composite cables 10, which may be stranded or more preferably helically stranded cables, and which may be used in forming a submersible composite cable (e.g., 20, 20' or 20") according to some non-limiting exemplary embodiments of the present disclosure. As illustrated by the exemplary embodiments shown in FIGS. 2A and 2C, the composite cable 10 may include a single composite wire 2 defining a center longitudinal axis, a first layer comprising a first plurality of composite wires 4 which may be stranded around the single composite wire 2 in a first lay direction, and a second layer comprising a second plurality of composite wires 6 which may be stranded around the first plurality of composite wires 4 in the first lay direction.

Figure 2A:
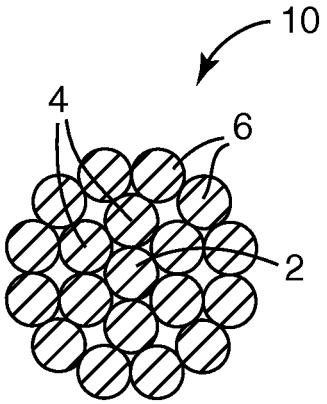
FIGS. 2A-2D are cross-sectional end views of exemplary composite cables useful in preparing exemplary embodiments of submersible composite power cables of the present disclosure.
Figure 2B:
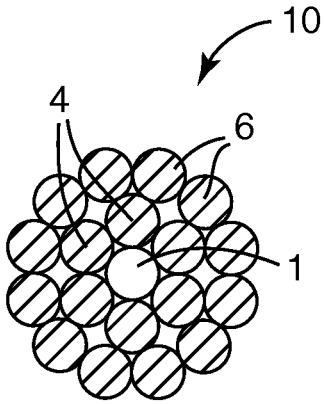
Figure 2C:
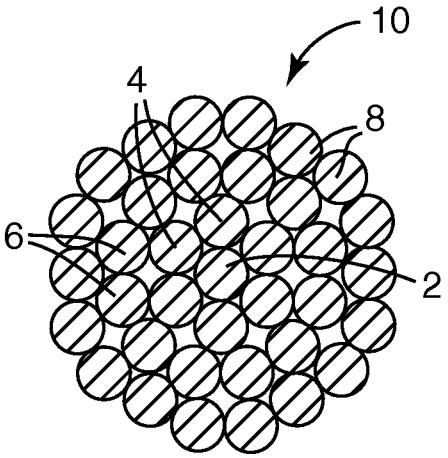

Optionally, as shown in FIG. 2C, a third layer comprising a third plurality of composite wires 8 may be stranded around the second plurality of composite wires 6 in the first lay direction to form composite cable 10. Optionally, a fourth layer (not shown) or even more additional layers of composite wires may be stranded around the second plurality of composite wires 6 in the first lay direction to form a composite cable.

Figure 2D:
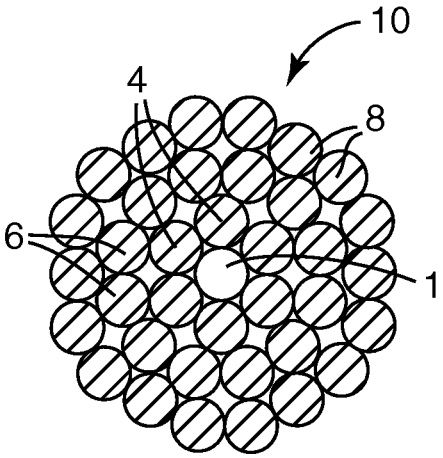

In other exemplary embodiments shown in FIGS. 2B and 2D, the composite cable 10 may include a single non-composite wire 1 (which may be, for example, a ductile metal wire) defining a center longitudinal axis, a first layer comprising a first plurality of composite wires 4 which may be stranded around the single non-composite wire 1 in a first lay direction, and a second layer comprising a second plurality of composite wires 6 which may be stranded around the first plurality of composite wires 4 in the first lay direction.

Optionally, as shown in FIG. 2D, a third layer comprising a third plurality of composite wires 8 may be stranded around the second plurality of composite wires 6 in the first lay direction to form composite cable 10. Optionally, a fourth layer (not shown) or even more additional layers of composite wires may be stranded around the second plurality of composite wires 6 in the first lay direction to form a composite cable.

As noted above, in some exemplary embodiments, the composite cables 10 comprise a plurality of composite wires. In some exemplary embodiments, one or more of the composite cables 10 may be stranded. In certain exemplary embodiments, the electrically conductive non-composite cable comprising the core (e.g., 11, 11' or 11") may alternatively or additionally be stranded. In certain particular exemplary embodiments, the stranded cable, whether entirely composite, partially composite or entirely non-composite, may be helically stranded. Suitable stranding methods, configurations and materials are disclosed in U.S. Pat. App. Pub. No. 2010/0038112 (Grether).

In further exemplary embodiments of the disclosure related to helically stranded composite cables 10 used in forming a submersible composite cable (e.g., 20, 20' or 20"), two or more stranded layers of composite wires (e.g., 4, 6 and 8) may be helically wound about a single center composite wire 2 (FIGS. 2A-2C) or non-composite wire 1 (FIGS. 2B-2D) defining a center longitudinal axis, provided that each successive layer of composites wires is wound in the same lay direction as each preceding layer of composite wires. Furthermore, it will be understood that while a right hand lay may be used for each layer (12, 14 and 16), a left hand lay may alternatively be used for each layer (12, 14 and 16).

In some exemplary embodiments (FIGS. 2A-2D), the stranded composite cable 10 comprises a single composite wire 2 (FIGS. 2A-2C) or non-composite wire 1 (FIGS. 2B-2D) defining a center longitudinal axis, a first plurality of composite wires 4 stranded around the single composite wire 2 in a first lay direction at a first lay angle defined relative to the center longitudinal axis and having a first lay length, and a second plurality of composite wires 6 stranded around the first plurality of composite wires 4 in the first lay direction at a second lay angle defined relative to the center longitudinal axis and having a second lay length.

In additional exemplary embodiments, the stranded composite cable 10 optionally further comprises a third plurality of composite wires 8 stranded around the second plurality of composite wires 6 in the first lay direction at a third lay angle defined relative to the center longitudinal axis and having a third lay length, the relative difference between the second lay angle and the third lay angle being no greater than about 4°.

In further exemplary embodiments (not shown), the stranded cable may further comprise additional (e.g., subsequent) layers (e.g., a fourth, fifth, or other subsequent layer) of composite wires stranded around the third plurality of composite wires 8 in the first lay direction at a lay angle defined relative to the common longitudinal axis, wherein the composite wires in each layer have a characteristic lay length, the relative difference between the third lay angle and the fourth or subsequent lay angle being no greater than about 4°. Embodiments in which four or more layers of stranded composite wires are employed preferably make use of composite wires having a diameter of 0.5 mm or less.

In some exemplary embodiments, the relative (absolute) difference between the first lay angle and the second lay angle is greater than 0° and no greater than about 4°. In certain exemplary embodiments, the relative (absolute) difference between one or more of the first lay angle and the second lay angle, the second lay angle and the third lay angle, is no greater than 4°, no greater than 3°, no greater than 2°, no greater than 1°, or no greater than 0.5°. In certain exemplary embodiments, one or more of the first lay angle equals the second lay angle, the second lay angle equals the third lay angle, and/or each succeeding lay angle equals the immediately preceding lay angle.

In further embodiments, one or more of the first lay length is less than or equal to the second lay length, the second lay length is less than or equal to the third lay length, the fourth lay length is less than or equal to an immediately subsequent lay length, and/or each succeeding lay length is less than or equal to the immediately preceding lay length. In other embodiments, one or more of the first lay length equals the second lay length, the second lay length equals the third lay length, and/or each succeeding lay length equals the immediately preceding lay length. In some embodiments, it may be preferred to use a parallel lay, as is known in the art.

In additional exemplary embodiments, the composite cables may further comprise a plurality of metal wires. Various exemplary stranded composite cables (e.g., 10', 10") including a plurality of metal wires (e.g., 28, 28', 28") are illustrated by cross-sectional end views in FIGS. 3A-3E. In each of the illustrated embodiments of FIGS. 3A-3E, it is understood that the composite wires (4, 6, and 8) are stranded about a single center composite core wire 2 defining a center longitudinal axis, preferably in a lay direction (not shown) which is the same for each corresponding layer of composite wires (4, 6, and 8). Such lay direction may be clockwise (right hand lay) or counter-clockwise (left hand lay). The stranded composite cables 10 may be used as intermediate articles that are later incorporated into final submersible composite cables (e.g., 20, 20', 20" as previously shown in FIGS. 1A-1C), for example, submersible composite tethers, submersible composite umbilicals, intervention cables, and the like.

FIGS. 3A-3E illustrate exemplary embodiments of stranded composite cables (e.g., 10' and 10") in which one or more additional layers of ductile wires (e.g., 28, 28', 28"), for example, ductile metal conductor wires, are stranded, more preferably helically stranded, around the exemplary composite cable 10 of FIG. 2A. It will be understood, however, that the disclosure is not limited to these exemplary embodiments, and that other embodiments, using other composite cable cores (for example, composite cables 10 of FIGS. 2B, 2C and 2D, and the like), are within the scope of this disclosure.

Figure 3A:
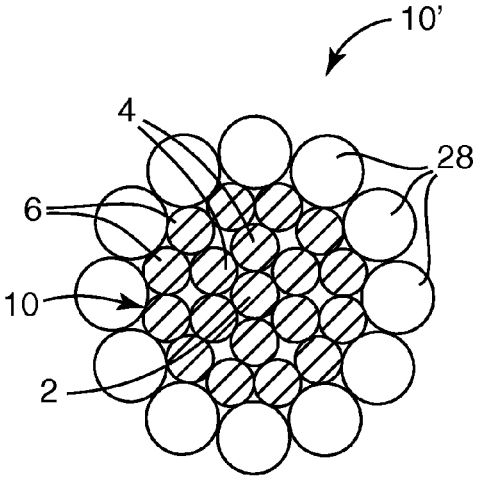
FIGS. 3A-3E are cross-sectional end views of various composite cables including one or more layers comprising a plurality of metal wires stranded around the helically stranded composite wires, useful in preparing exemplary embodiments of submersible composite power cables of the present disclosure.

Thus, in the particular embodiment illustrated by FIG. 3A, the stranded composite cable 10' comprises a first plurality of ductile wires 28 stranded around the stranded composite core cable 10 shown in FIG. 2A. In an additional embodiment illustrated by FIG. 3B, the stranded composite cable 10' comprises a second plurality of ductile wires 28' stranded around the first plurality of ductile wires 28 of stranded composite cable 10 of FIG. 4A. In a further embodiment illustrated by FIG. 4C, the stranded composite cable 10' comprises a third plurality of ductile wires 28" stranded around the second plurality of ductile wires 28' of stranded composite cable 10 of FIG. 2A.

Figure 3B:
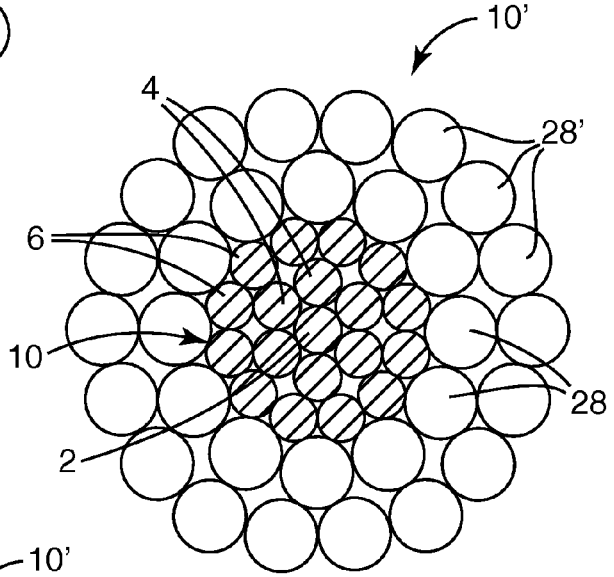
Figure 3C:
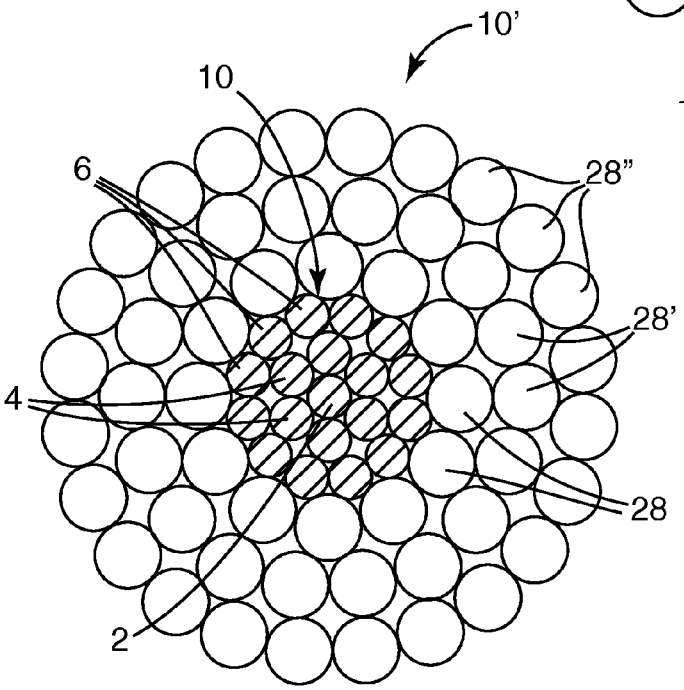
Figure 3D:
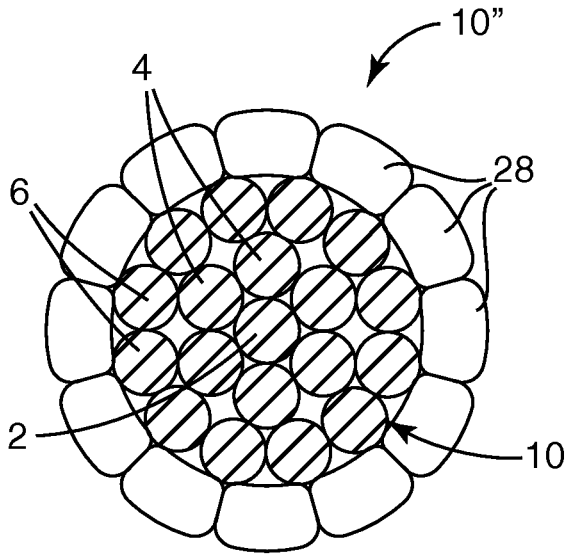
Figure 3E:
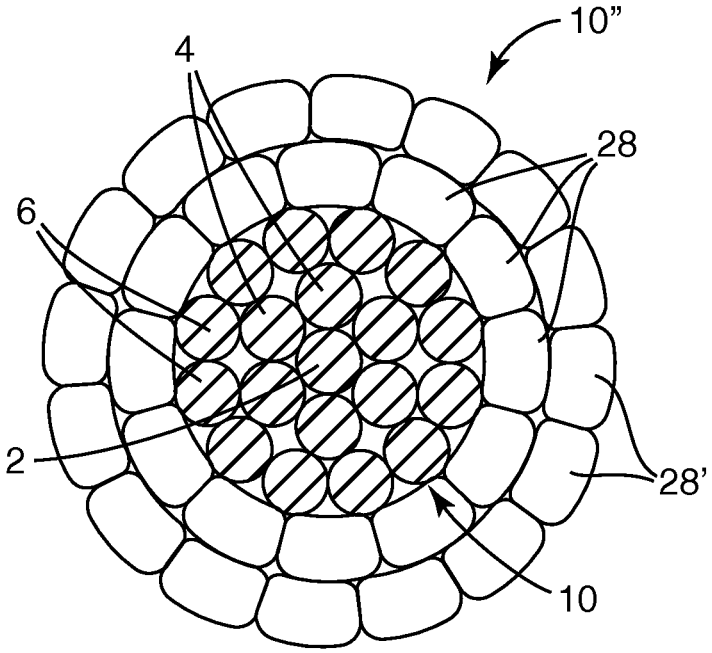

In the particular embodiments illustrated by FIGS. 3A-3C, the respective stranded cables 10' have a core comprising the stranded composite cable 10 of FIG. 2A, which includes a single wire 2 defining a center longitudinal axis, a first layer comprising a first plurality of composite wires 4 stranded around the single composite wire 2 in a first lay direction, a second layer comprising a second plurality of composite wires 6 stranded around the first plurality of composite wires 4 in the first lay direction. In certain exemplary embodiments, the first plurality of ductile wires 28 is stranded in a lay direction opposite to that of an adjoining radial layer, for example, the second layer comprising the second plurality of composite wires 6.

In other exemplary embodiments, the first plurality of ductile wires 28 is stranded in a lay direction the same as that of an adjoining radial layer, for example, the second layer comprising the second plurality of composite wires 6. In further exemplary embodiments, at least one of the first plurality of ductile wires 28, the second plurality of ductile wires 28', or the third plurality of ductile wires 28", is stranded in a lay direction opposite to that of an adjoining radial layer, for example, the second layer comprising the second plurality of composite wires 6.

In further exemplary embodiments, each ductile wire (28, 28', or 28") has a cross-sectional shape, in a direction substantially normal to the center longitudinal axis, selected from circular, elliptical, or trapezoidal. FIGS. 3A-3C illustrate embodiments wherein each ductile wire (28, 28', or 28") has a cross-sectional shape, in a direction substantially normal to the center longitudinal axis, that is substantially circular. In the particular embodiment illustrated by FIG. 3D, the stranded composite cable 10" comprises a first plurality of generally trapezoidal-shaped ductile wires 28 stranded around the stranded composite core cable 10 shown in FIG. 2A. In a further embodiment illustrated by FIG. 3E, the stranded composite cable 10" further comprises a second plurality of generally trapezoidal-shaped ductile wires 28' stranded around the stranded composite cable 10 of FIG. 2A.

In further exemplary embodiments, some or all of the ductile wires (28, 28', or 28") may have a cross-sectional shape, in a direction substantially normal to the center longitudinal axis, that is "Z" or "S" shaped (not shown). Wires of such shapes are known in the art, and may be desirable, for example, to form an interlocking outer layer of the cable.

In additional embodiments, the ductile wires (28, 28', or 28") comprise at least one metal selected from the group consisting of copper, aluminum, iron, zinc, cobalt, nickel, chromium, titanium, tungsten, vanadium, zirconium, manganese, silicon, alloys thereof, and combinations thereof.

Although FIGS. 3A-3E show a single center composite core wire 2 defining a center longitudinal axis, it is additionally understood that single center composite core wire 2 may alternatively be a ductile metal wire 1, as previously illustrated in FIGS. 2B and 2D. It is further understood that each layer of composite wires exhibits a lay length, and that the lay length of each layer of composite wires may be different, or preferably, the same lay length.

Furthermore, it is understood that in some exemplary embodiments, each of the composite wires has a cross-sectional shape, in a direction substantially normal to the center longitudinal axis, generally circular, elliptical, or trapezoidal. In certain exemplary embodiments, each of the composite wires has a cross-sectional shape that is generally circular, and the diameter of each composite wire is at least about 0.1 mm, more preferably at least 0.5 mm; yet more preferably at least 1 mm, still more preferably at least 2 mm, most preferably at least 3 mm; and at most about 15 mm, more preferably at most 10 mm, still more preferably at most 5 mm, even more preferably at most 4 mm, most preferably at most 3 mm. In other exemplary embodiments, the diameter of each composite wire may be less than 1 mm, or greater than 5 mm.

Typically the average diameter of the single center wire, having a generally circular cross-sectional shape, is in a range from about 0.1 mm to about 15 mm. In some embodiments, the average diameter of the single center wire is desirably is at least about 0.1 mm, at least 0.5 mm, at least 1 mm, at least 2 mm, at least 3 mm, at least 4 mm, or even up to about 5 mm. In other embodiments, the average diameter of the single central wire is less than about 0.5 mm, less than 1 mm, less than 3 mm, less than 5 mm, less than 10 mm, or less than 15 mm.

In additional exemplary embodiments not illustrated by FIGS. 3A-3E, the stranded composite cable may include more than three stranded layers of composite wires about the single wire defining a center longitudinal axis. In certain exemplary embodiments, each of the composite wires in each layer of the composite cable may be of the same construction and shape; however this is not required in order to achieve the benefits described herein.

In a further aspect, the present disclosure provides various embodiments of a stranded electrical power transmission cable comprising a composite core and a conductor layer around the composite core, and in which the composite core comprises any of the above-described stranded composite cables. In some embodiments, the electrical power transmission cable may be useful as a submersible electrical power transmission cable. In certain exemplary embodiments, the conductor layer comprises a metal layer which contacts substantially an entire surface of the composite cable core. In other exemplary embodiments, the conductor layer comprises a plurality of ductile metal conductor wires stranded about the composite cable core.

For stranded composite cables comprising a plurality of composite wires (e.g., 2, 4, 6) and optionally, ductile metal wires (e.g., 28, 28', 28"), it is desirable, in some embodiments, to hold the composite wires (e.g., at least the second plurality of composite wires 6 in second layer 14 of FIGS. 4A-4D) together during or after stranding using a maintaining means, for example, a tape overwrap, with or without adhesive, or a binder (see, e.g., U.S. Pat. No. 6,559,385 B1 (Johnson et al.)). FIGS. 4A-4D and 5 illustrate various embodiments using a maintaining means in the form of a tape 18 to hold the composite wires together after stranding.

Figure 4A:
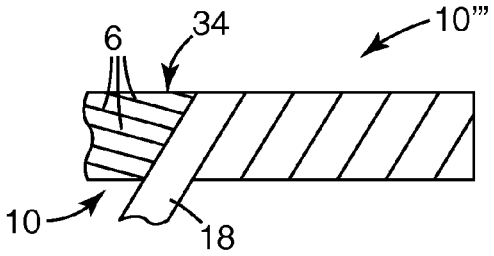
FIG. 4A is a side view of an exemplary stranded composite cable including maintaining means around a stranded composite wire core, useful in preparing exemplary embodiments of submersible composite power cables of the present disclosure.

FIG. 4A is a side view of an exemplary stranded composite cable 10' using a maintaining means, with an exemplary maintaining means comprising a tape 18 partially applied to the stranded composite core cable 10 of FIG. 1A, wherein the tape 18 is wrapped around the composite wires (2, 4, 6, although only the outer layer of composite wires 6 is shown in FIG. 4A). Although the exemplary stranded composite cable 10 of FIG. 1A is shown in FIGS. 4A-4D for purposes of illustration, it will be understood that any of the stranded composite cables of the present disclosure (e.g. stranded composite cables 10 of FIGS. 2B-2D, stranded composite cables 10' of FIGS. 3A-3C, stranded composite cables 10" of FIGS. 3A-3C, and the like) may be substituted for the exemplary stranded composite cable 10 of FIG. 1A in any of the illustrative embodiments described herein, particularly those embodiments shown in the Drawings.

Figure 4B:
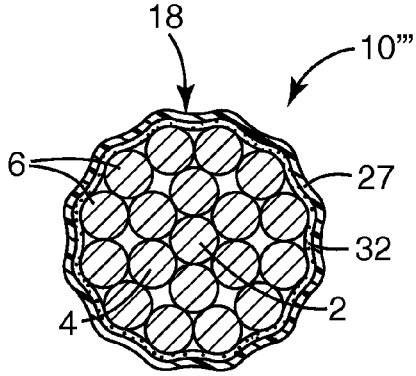
FIGS. 4B-4D are cross-sectional end views of exemplary stranded composite cables including various maintaining means around a stranded composite wire core, useful in preparing exemplary embodiments of submersible composite power cables of the present disclosure.
Figure 4C:
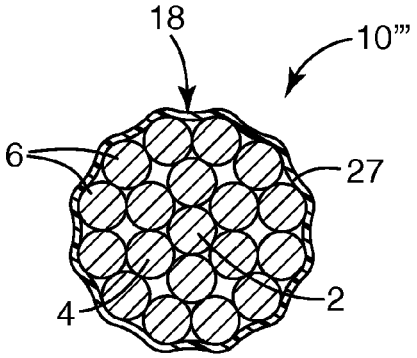

As shown in FIG. 4B, tape 18 may comprise a backing 27 with an adhesive layer 32. Alternatively, as shown in FIG. 4C, the tape 18 may comprise only a backing 27, without an adhesive. In certain embodiments, tape 18 may act as an electrically insulating sheath surrounding the composite wires.

In certain exemplary embodiments, tape 18 may be wrapped such that each successive wrap abuts the previous wrap without a gap and without overlap, as is illustrated in FIG. 4A. Alternatively, in some embodiments, successive wraps may be spaced so as to leave a gap between each wrap or so as to overlap the previous wrap. In one preferred embodiment, the tape 18 is wrapped such that each wrap overlaps the preceding wrap by approximately ⅓ to ½ of the tape width. In certain presently preferred embodiments, the tape 18 wrapping covers only a portion of the exterior surface of the composite core cable 10. Preferably, at most 90%, 80%, 70%, 60%, 50%, 40%, 30% or even 25% of the exterior surface of the composite core cable 10 is covered by the tape 18.

FIG. 4B is an end view of the stranded cable of FIG. 4A in which the maintaining means is a tape 18 comprises a backing 27 with an adhesive 32. In this exemplary embodiment, suitable adhesives include, for example, (meth)acrylate (co)polymer based adhesives, poly(α-olefin) adhesives, block copolymer based adhesives, natural rubber based adhesives, silicone based adhesives, and hot melt adhesives. Pressure sensitive adhesives may be preferred in certain embodiments.

In further exemplary embodiments, suitable materials for tape 18 or backing 27 include metal foils, particularly aluminum; polyester; polyimide; and glass reinforced backings; provided the tape 18 is strong enough to maintain the elastic bend deformation and is capable of retaining its wrapped configuration by itself, or is sufficiently restrained if necessary. One particularly preferred backing 20 is aluminum. Such a backing preferably has a thickness of between 0.002 and 0.005 inches (0.05 to 0.13 mm), and a width selected based on the diameter of the stranded composite cable 10. For example, for a stranded composite core cable 10 having two layers of stranded composite wires such as such as illustrated in FIG. 4A, and having a diameter of about 0.5 inches (1.3 cm), an aluminum tape having a width of 1.0 inch (2.5 cm) is preferred.

Some presently preferred commercially available tapes include the following Metal Foil Tapes (available from 3M Company, St. Paul, Minn.): Tape 438, a 0.005 inch thick (0.13 mm) aluminum backing with acrylic adhesive and a total tape thickness of 0.0072 inches (0.18 mm); Tape 431, a 0.0019 inch thick (0.05 mm) aluminum backing with acrylic adhesive and a total tape thickness of 0.0031 inches (0.08 mm); and Tape 433, a 0.002 inch thick (0.05 mm) aluminum backing with silicone adhesive and a total tape thickness of 0.0036 inches (0.09 mm). A suitable metal foil/glass cloth tape is Tape 363 (available from 3M Company, St. Paul, Minn.), as described in the Examples. A suitable polyester backed tape includes Polyester Tape 8402 (available from 3M Company, St. Paul, Minn.), with a 0.001 inch thick (0.03 mm) polyester backing, a silicone based adhesive, and a total tape thickness of 0.0018 inches (0.03 mm).

FIG. 4C is an end view of the stranded cable of FIG. 4A in which tape 18 comprises a backing 27 without adhesive. When tape 18 is a backing 27 without adhesive, suitable materials for backing 27 include any of those just described for use with an adhesive, with a preferred backing being an aluminum backing having a thickness of between 0.002 and 0.005 inches (0.05 to 0.13 mm) and a width of 1.0 inch (2.54 cm).

When using tape 18 as the maintaining means, either with or without adhesive 32, the tape may be applied to the stranded cable with conventional tape wrapping apparatus as is known in the art. Suitable taping machines include those available from Watson Machine, International, Patterson, N.J., such as model number CT-300 Concentric Taping Head. The tape overwrap station is generally located at the exit of the cable stranding apparatus and is applied to the helically stranded composite wires prior to the cable 10 being wound onto a take up spool. The tape 18 is selected so as to maintain the stranded arrangement of the elastically deformed composite wires.

Figure 4D:
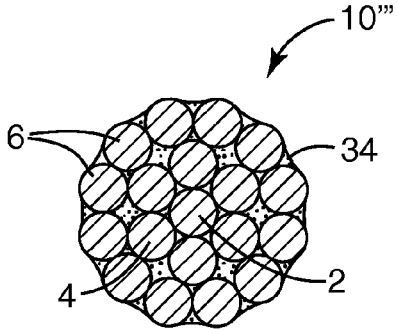

FIG. 4D illustrates alternative exemplary embodiments of a stranded composite cable 10'" with a maintaining means in the form of a binder 34 applied to the stranded composite core cable 10 of FIG. 2A to maintain the composite wires (2, 4, 6)

in their stranded arrangement. Suitable binders 34 include pressure sensitive adhesive compositions comprising one or more poly(alpha-olefin)homopolymers, copolymers, terpolymers, and tetrapolymers derived from monomers containing 6 to 20 carbon atoms and photoactive crosslinking agents as described in U.S. Pat. No. 5,112,882 (Babu et al.). Radiation curing of these materials provides adhesive films having an advantageous balance of peel and shear adhesive properties.

Alternatively, the binder 34 may comprise thermoset materials, including but not limited to epoxies. For some binders, it is preferable to extrude or otherwise coat the binder 34 onto the stranded composite core cable 10 while the wires are exiting the cabling machine as discussed above. Alternatively, the binder 34 can be applied in the form of an adhesive supplied as a transfer tape. In this case, the binder 34 is applied to a transfer or release sheet (not shown). The release sheet is wrapped around the composite wires of the stranded composite core cable 10. The backing is then removed, leaving the adhesive layer behind as the binder 34. In further embodiments, an adhesive 32 or binder 34 may optionally be applied around each individual composite wire, or between any suitable layer of composite and non-composite wires as is desired.

Figure 5:
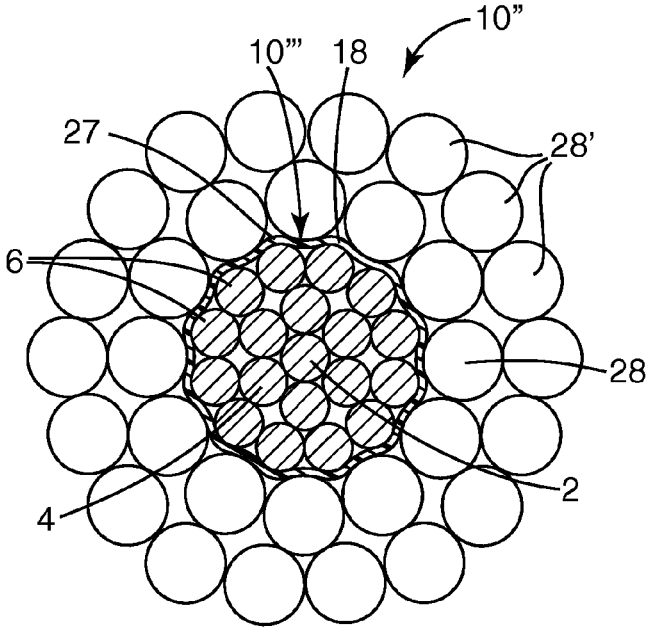
FIG. 5 is a cross-sectional end view of an exemplary stranded composite cable including a maintaining means around a stranded composite wire core, and one or more layers comprising a plurality of metal wires stranded around the stranded composite wire core, useful in preparing exemplary embodiments of submersible composite power cables of the present disclosure.

Furthermore, in the particular embodiment illustrated by FIG. 5, the stranded composite cable 10" comprises a first plurality of ductile wires 28 and a second plurality of ductile wires 28" stranded around a tape-wrapped composite core cable 10'" illustrated by FIG. 4C, and a second plurality of ductile wires 28' stranded around the first plurality of ductile wires 28. Tape 18 is formed by wrapping backing 27 around the composite core shown in FIG. 2A, which includes a single composite wire 2 defining a center longitudinal axis, a first layer comprising a first plurality of composite wires 4 which may be stranded around the single composite wire 2 in a first lay direction, and a second layer comprising a second plurality of composite wires 6 which may be stranded around the first plurality of composite wires 4 in the first lay direction.

In one presently preferred embodiment, the maintaining means does not significantly add to the total diameter of the stranded composite core cable 10'". Preferably, the outer diameter of the stranded composite cable including the maintaining means is no more than 110% of the outer diameter of the plurality of stranded composite wires (2, 4, 6, 8, etc.) excluding the maintaining means, more preferably no more than 105%, and most preferably no more than 102%.

It will be recognized that the composite wires have a significant amount of elastic bend deformation when they are stranded on conventional cabling equipment. This significant elastic bend deformation would cause the wires to return to their un-stranded or unbent shape if there were not a maintaining means for maintaining the helical arrangement of the wires. Therefore, in some embodiments, the maintaining means is selected so as to maintain significant elastic bend deformation of the plurality of stranded composite wires (e.g., 2, 4, 6 in FIG. 2A).

Furthermore, the intended application for the stranded composite cable 10" (or 10', 10'" and the like) may suggest certain maintaining means are better suited for the application. For example, when the stranded composite cable 10" is used for electrical power transmission in a submersible composite tether or umbilical cable, either the binder 24 or the tape 18 without an adhesive 22 should be selected so as to not adversely affect the electrical power transmission at the temperatures, depths, and other conditions experienced in this application. When an adhesive tape 18 is used as the maintaining means, both the adhesive 32 and the backing 27 should be selected to be suitable for the intended application.

In certain exemplary embodiments, the stranded composite wires (e.g., 2, 4, 6 in FIG. 2A) each comprise a plurality of continuous fibers in a matrix as will be discussed in more detail later. Because the wires are composite, they do not generally accept plastic deformation during the cabling or stranding operation, which would be possible with ductile metal wires. For example, in prior art arrangements including ductile wires, the conventional cabling process could be carried out so as to permanently plastically deform the composite wires in their helical arrangement. The present disclosure allows use of composite wires which can provide superior desired characteristics compared to conventional non-composite wires. The maintaining means allows the stranded composite cable to be conveniently handled when being incorporated into a subsequent final article, such as a submersible composite tether or umbilical cable.

Figure 6A:
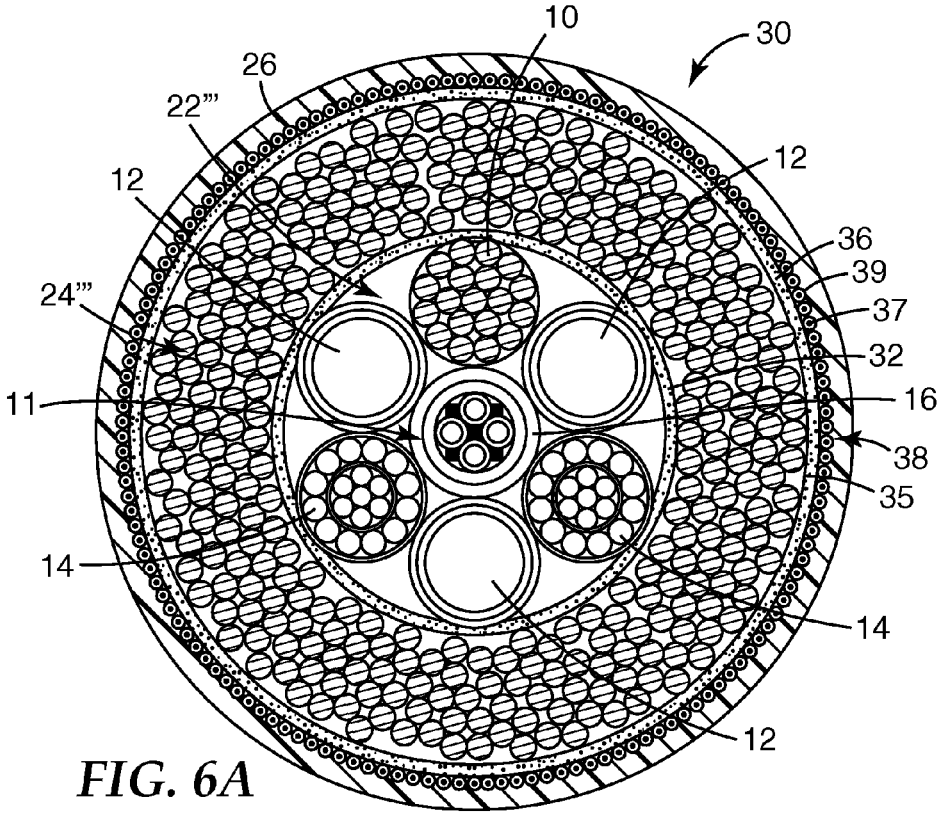
FIGS. 6A-6C are cross-sectional end views of exemplary embodiments of submersible composite power cables incorporating various exemplary armor elements according to some embodiments of the present disclosure.
Figure 6B:
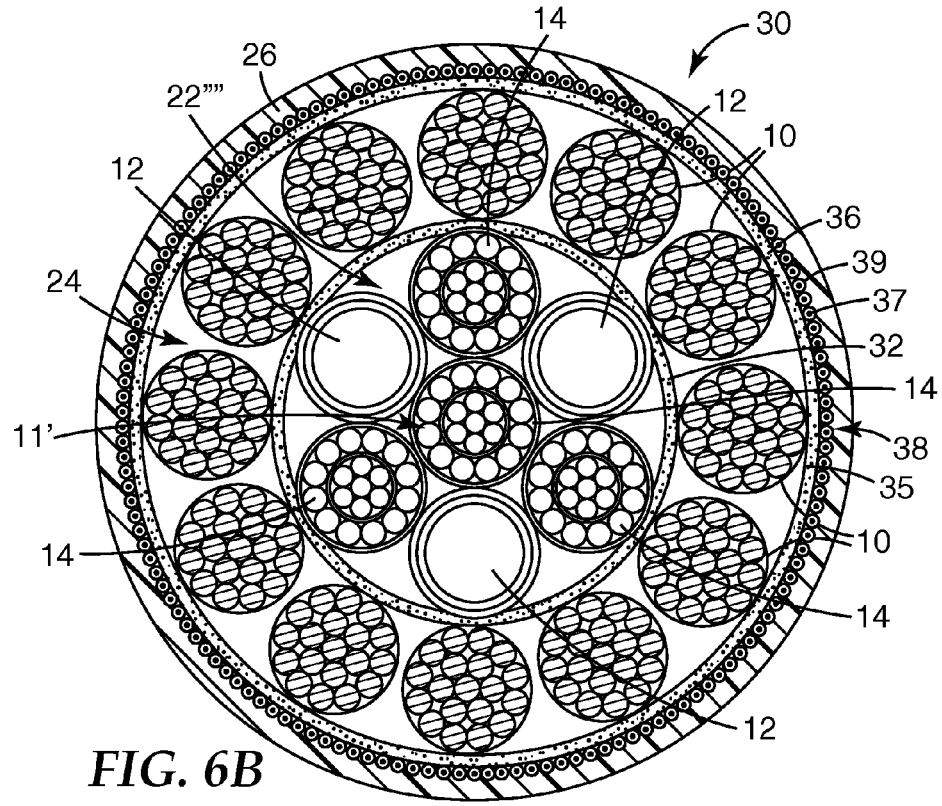
Figure 6C:
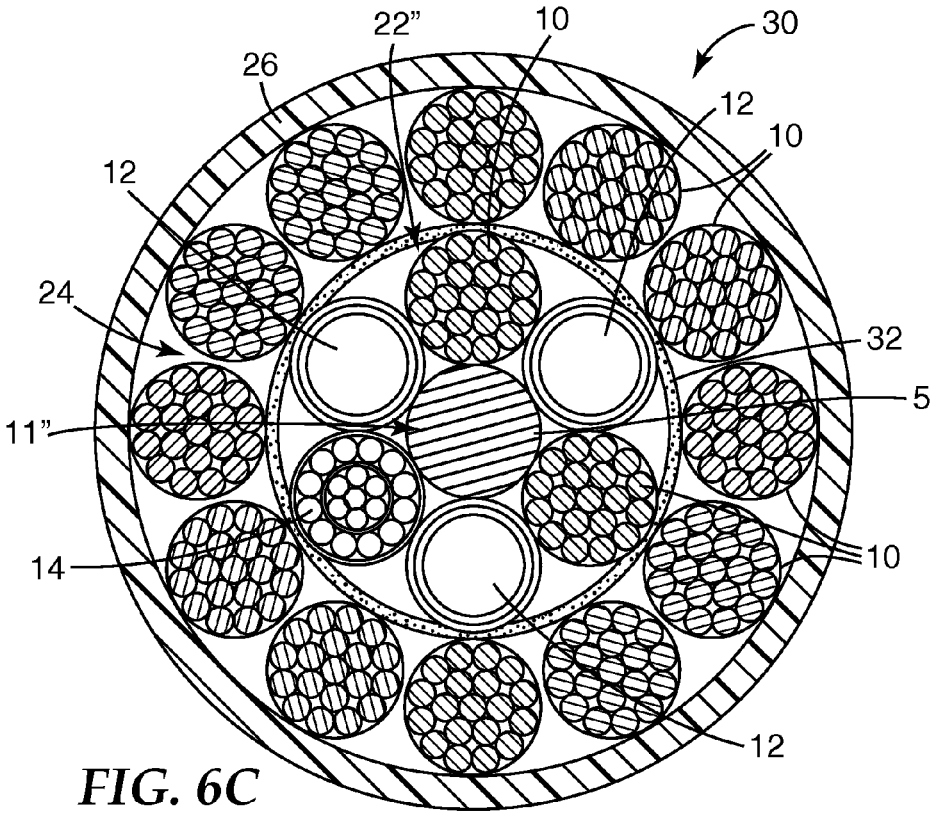

In an additional aspect illustrated in FIGS. 6A-6C, the present disclosure provides a submersible composite cable 30 comprising a core cable (11, 11', 11"), for example an electrically conductive core cable, a fiber optic cable, a structural element, and/or a fluid carrying element or tube; a plurality of elements 12 arranged around the core element (11, 11', 11" for FIGS. 6A-6B, respectively) in at least one cylindrical layer (e.g., 22", 22'", 22"" for FIGS. 6A-6B, respectively) defined about a center longitudinal axis of the core cable when viewed in a radial cross section; a plurality of composite wires (which may be in the form of one or more composite cables 10) surrounding the plurality of elements 12 in at least one cylindrical layer (e.g., 24'" of FIG. 6A; 24 of FIGS. 6B-6C) about the center longitudinal axis of the electrically conductive core cable (11, 11', 11"); and a sheath 26, which may be an insulative sheath, surrounding the plurality of composite wires. Each element 12 is preferably selected from a fluid transport element, an electrical power transmission element, an electrical signal transmission element, a light transmission element, a weight element, a buoyancy element, a filler element, or an armor element.

In some exemplary embodiments, the sheath 26 may have desirable characteristics. For example, in some embodiments, the sheath 26 may be insulative (i.e. electrically insulative and/or thermally or acoustically insulative). In certain exemplary embodiments, the sheath 26 provides a protective capability to the underlying a core cable (11, 11', 11"), plurality of elements 12, and optional plurality of electrically conductive non-composite cables 14. The protective capability may be, for example, improved puncture resistance, improved corrosion resistance, improved resistance to extremes of high or low temperature, improved friction resistance, and the like.

Preferably, the sheath 26 comprises a thermoplastic polymeric material, more preferably a thermoplastic polymeric material selected from high density polyolefins (e.g. high density polyethylene), medium density polyolefins (e.g. medium density polyethylene), and/or thermoplastic fluoropolymers. Suitable fluoropolymers include fluorinated ethylenepropylene copolymer (FEP), polytetrafluoroethylene (PTFE), ethylenetetrafluorethylene (ETFE), ethylenechlorotrifluoroethylene (ECTFE), polyvinylidene fluoride (PVDF), polyvinyl fluoride (PVF), tetrafluoroethylene polymer (TFV). Particularly suitable fluoropolymers are those sold under the trade names DYNEON THV FLUOROPLASTICS, DYNEON ETFE FLUOROPLASTICS, DYNEON FEP FLUOROPLASTICS, DYNEON PFA FLUOROPLASTICS, and DYNEON PVDF FLUOROPLASTICS (all available from 3M Company, St. Paul, Minn.).

In some exemplary embodiments, the sheath 26 may further comprise an armor element which preferably also functions as a strength element. In other presently preferred exemplary embodiments shown in FIGS. 6A-6B, the armor and/or strength element 39 comprises a plurality of wires 37 surrounding the core cable and arranged in a cylindrical layer 38 (FIGS. 6A-6B). Preferably, the wires 37 are selected from metal (e.g. steel) wires, metal matrix composite wires, polymer matrix composite wires, and combinations thereof.

In some exemplary embodiments shown in FIGS. 6A-6B, the submersible composite cable 30 may further comprise an armor or reinforcing layer (e.g., 32, 36). In certain exemplary embodiments, the armor layer comprises one or more cylindrical layers (e.g., 32, 36) surrounding at least the core cable (11, 11"). In some exemplary embodiments shown in FIGS. 6A-6B, the armor or reinforcing layer (32, 36) may take the form of a tape or fabric layer (e.g., 32, 36) formed radially within the submersible composite cable 30, and preferably comprising a plurality of fibers that surrounds or is wrapped around at least the core cable (11, 11") and the plurality of composite wires, and more preferably the elements 12 and the optional electrically conductive non-composite cables 14, as illustrated in FIGS. 6A-6B. Preferably, the fibers are selected from poly(aramid) fibers, ceramic fibers, boron fibers, carbon fibers, metal fibers, glass fibers, and combinations thereof.

In certain embodiments, the armor or reinforcing layer (32, 36) and/or sheath 26 may also act as an insulative element for an electrically conductive composite or non-composite cable. In such embodiments, the armor or reinforcing layer (32, 36) and/or sheath 26 preferably comprises an insulative material, more preferably an insulative polymeric material as described above.

In certain exemplary embodiments illustrated by FIGS. 6A-6C, the stranded composite cable and/or electrically conductive non-composite cable comprising the core (11, 11', 11") comprises at least one, and preferably a plurality of ductile metal wires. In additional exemplary embodiments, each of the plurality of metal wires, when viewed in a radial cross section, has a cross-sectional shape selected from the group consisting of circular, elliptical, trapezoidal, S-shaped, and Z-shaped. In certain presently preferred exemplary embodiments, at least a portion of the plurality of metal wires may comprise hollow wires or tubes useful in transporting fluids.

In some particular exemplary embodiments, the plurality of metal wires comprise at least one metal selected from the group consisting of iron, steel, zirconium, copper, tin, cadmium, aluminum, manganese, zinc, cobalt, nickel, chromium, titanium, tungsten, vanadium, their alloys with each other, their alloys with other metals, their alloys with silicon, and combinations thereof.

In some particular additional exemplary embodiments, at least one of the composite cables 10 within submersible power cable 30 is a stranded composite cable comprising a plurality of cylindrical layers of the composite wires stranded about a center longitudinal axis of the at least one composite cable when viewed in a radial cross section. In certain exemplary embodiments, the at least one stranded composite cable is helically stranded. In certain particular exemplary embodiments, each cylindrical layer is stranded at a lay angle in a lay direction that is the same as a lay direction for each adjoining cylindrical layer. In certain presently preferred embodiments, a relative difference between lay angles for each adjoining cylindrical layer is no greater than 3°.

In additional exemplary embodiments, a plurality of electrically conductive non-composite cables 14, which may be conductors and/or load bearing elements, may be included in one or more of the cylindrical layers. Furthermore, it will be understood that in any embodiments of the submersible composite cable 30 of the present disclosure, the plurality of elements 12 and optional plurality of electrically conductive non-composite cables 14 may form various stranded radial layers about the center longitudinal axis of the submersible composite cable 30 (see e.g. FIGS. 6A-6C). Preferably, each stranded radial layer is helically stranded about the center longitudinal axis of the cable.

In further exemplary embodiments, the composite wires have a cross-sectional shape selected from the group consisting of circular, elliptical, and trapezoidal. In some exemplary embodiments, each of the composite wires is a fiber reinforced composite wire. In certain exemplary embodiments, at least one of the fiber reinforced composite wires is reinforced with one of a fiber tow or a monofilament fiber. In other exemplary embodiments, each of the composite wires is selected from the group consisting of a metal matrix composite wire and a polymer composite wire. In further exemplary embodiments, some of the composite wires are selected to be metal matrix composite wires and polymer matrix composite wires. In certain other exemplary embodiments, the polymer composite wire comprises at least one continuous fiber in a polymer matrix. In some exemplary embodiments, the at least one continuous fiber comprises metal, carbon, ceramic, glass, or combinations thereof.

In some exemplary embodiments, the at least one continuous fiber comprises titanium, tungsten, boron, shape memory alloy, carbon, carbon nanotubes, graphite, silicon carbide, poly(aramid), poly(p-phenylene-2,6-benzobisoxazole, or combinations thereof. In certain exemplary embodiments, the polymer matrix comprises a (co)polymer selected from the group consisting of an epoxy, an ester, a vinyl ester, a polyimide, a polyester, a cyanate ester, a phenolic resin, a bismaleimide resin, polyetheretherketone, and combinations thereof.

In other exemplary embodiments, the metal matrix composite wire comprises at least one continuous fiber in a metal matrix. In some exemplary embodiments, the at least one continuous fiber comprises a material selected from the group consisting of ceramics, glasses, carbon nanotubes, carbon, silicon carbide, boron, iron, steel, ferrous alloys, tungsten, titanium, shape memory alloy, and combinations thereof. In certain exemplary embodiments, the metal matrix comprises aluminum, zinc, tin, magnesium, alloys thereof, or combinations thereof. In certain presently preferred embodiments, the metal matrix comprises aluminum, and the at least one continuous fiber comprises a ceramic fiber. Suitable ceramic fibers are available under the tradename NEXTEL ceramic fibers (available from 3M Company, St. Paul. Minn.), and include, for example, NEXTEL 312 ceramic fibers. In some particular presently preferred embodiments, the ceramic fiber comprises polycrystalline $\alpha$-$Al_2O_3$.

In further exemplary embodiments, the insulative sheath forms an outer surface of the submersible composite cable. In some exemplary embodiments, the insulative sheath comprises a material selected from the group consisting of a ceramic, a glass, a (co)polymer, and combinations thereof.

While the present disclosure may be practiced with any suitable composite wire, in certain exemplary embodiments, each of the composite wires is selected to be a fiber reinforced composite wire comprising at least one of a continuous fiber tow or a continuous monofilament fiber in a matrix.

A preferred embodiment for the composite wires comprises a plurality of continuous fibers in a matrix. A presently preferred fiber comprises polycrystalline $\alpha$-$Al_2O_3$. These preferred embodiments for the composite wires preferably have a tensile strain to failure of at least 0.4%, more preferably at least 0.7%. In some embodiments, at least 85% (in some embodiments, at least 90%, or even at least 95%) by number of the fibers in the metal matrix composite core are continuous.

Other composite wires that could be used with the present disclosure include glass/epoxy wires; silicon carbide/aluminum composite wires; carbon/aluminum composite wires; carbon/epoxy composite wires; carbon/polyetheretherketone (PEEK) wires; carbon/(co)polymer wires; and combinations of such composite wires.

Examples of suitable glass fibers include A-Glass, B-Glass, C-Glass, D-Glass, S-Glass, AR-Glass, R-Glass, fiberglass and paraglass, as known in the art. Other glass fibers may also be used; this list is not limited, and there are many different types of glass fibers commercially available, for example, from Corning Glass Company (Corning, N.Y.).

In some exemplary embodiments, continuous glass fibers may be preferred. Typically, the continuous glass fibers have an average fiber diameter in a range from about 3 micrometers to about 19 micrometers. In some embodiments, the glass fibers have an average tensile strength of at least 3 GPa, 4 GPa, and or even at least 5 GPa. In some embodiments, the glass fibers have a modulus in a range from about 60 GPa to 95 GPa, or about 60 GPa to about 90 GPa.

Examples of suitable ceramic fibers include metal oxide (e.g., alumina) fibers, boron nitride fibers, silicon carbide fibers, and combination of any of these fibers. Typically, the ceramic oxide fibers are crystalline ceramics and/or a mixture of crystalline ceramic and glass (i.e., a fiber may contain both crystalline ceramic and glass phases). Typically, such fibers have a length on the order of at least 50 meters, and may even have lengths on the order of kilometers or more. Typically, the continuous ceramic fibers have an average fiber diameter in a range from about 5 micrometers to about 50 micrometers, about 5 micrometers to about 25 micrometers about 8 micrometers to about 25 micrometers, or even about 8 micrometers to about 20 micrometers. In some embodiments, the crystalline ceramic fibers have an average tensile strength of at least 1.4 GPa, at least 1.7 GPa, at least 2.1 GPa, and or even at least 2.8 GPa. In some embodiments, the crystalline ceramic fibers have a modulus greater than 70 GPa to approximately no greater than 1000 GPa, or even no greater than 420 GPa.

Examples of suitable monofilament ceramic fibers include silicon carbide fibers. Typically, the silicon carbide monofilament fibers are crystalline and/or a mixture of crystalline ceramic and glass (i.e., a fiber may contain both crystalline ceramic and glass phases). Typically, such fibers have a length on the order of at least 50 meters, and may even have lengths on the order of kilometers or more. Typically, the continuous silicon carbide monofilament fibers have an average fiber diameter in a range from about 100 micrometers to about 250 micrometers. In some embodiments, the crystalline ceramic fibers have an average tensile strength of at least 2.8 GPa, at least 3.5 GPa, at least 4.2 GPa and or even at least 6 GPa. In some embodiments, the crystalline ceramic fibers have a modulus greater than 250 GPa to approximately no greater than 500 GPa, or even no greater than 430 GPa.

Suitable alumina fibers are described, for example, in U.S. Pat. No. 4,954,462 (Wood et al.) and U.S. Pat. No. 5,185,299 (Wood et al.). In some embodiments, the alumina fibers are polycrystalline alpha alumina fibers and comprise, on a theoretical oxide basis, greater than 99 percent by weight $Al_2O_3$ and 0.2-0.5 percent by weight $SiO_2$, based on the total weight of the alumina fibers. In another aspect, some desirable polycrystalline, alpha alumina fibers comprise alpha alumina having an average grain size of less than one micrometer (or even, in some embodiments, less than 0.5 micrometer). In another aspect, in some embodiments, polycrystalline, alpha alumina fibers have an average tensile strength of at least 1.6 GPa (in some embodiments, at least 2.1 GPa, or even, at least 2.8 GPa). Exemplary alpha alumina fibers are marketed under the trade designation "NEXTEL 610" (3M Company, St. Paul, Minn.).

Suitable aluminosilicate fibers are described, for example, in U.S. Pat. No. 4,047,965 (Karst et al). Exemplary aluminosilicate fibers are marketed under the trade designations "NEXTEL 440", "NEXTEL 550", and "NEXTEL 720" by 3M Company of St. Paul, Minn. Aluminoborosilicate fibers are described, for example, in U.S. Pat. No. 3,795,524 (Sowman). Exemplary aluminoborosilicate fibers are marketed under the trade designation "NEXTEL 312" by 3M Company. Boron nitride fibers can be made, for example, as described in U.S. Pat. No. 3,429,722 (Economy) and U.S. Pat. No. 5,780,154 (Okano et al.). Exemplary silicon carbide fibers are marketed, for example, by COI Ceramics of San Diego, Calif. under the trade designation "NICALON" in tows of 500 fibers, from Ube Industries of Japan, under the trade designation "TYRANNO", and from Dow Corning of Midland, Mich. under the trade designation "SYLRAMIC".

Suitable carbon fibers include commercially available carbon fibers such as the fibers designated as PANEX® and PYRON® (available from ZOLTEK, Bridgeton, Mo.), THORNEL (available from CYTEC Industries, Inc., West Paterson, N.J.), HEXTOW (available from HEXCEL, Inc., Southbury, Conn.), and TORAYCA (available from TORAY Industries, Ltd. Tokyo, Japan). Such carbon fibers may be derived from a polyacrylonitrile (PAN) precursor. Other suitable carbon fibers include PAN-IM, PAN-HM, PAN UHM, PITCH or rayon byproducts, as known in the art.

Additional suitable commercially available fibers include ALTEX (available from Sumitomo Chemical Company, Osaka, Japan), and ALCEN (available from Nitivy Company, Ltd., Tokyo, Japan).

Suitable fibers also include shape memory alloy (i.e., a metal alloy that undergoes a Martensitic transformation such that the metal alloy is deformable by a twinning mechanism below the transformation temperature, wherein such deformation is reversible when the twin structure reverts to the original phase upon heating above the transformation temperature). Commercially available shape memory alloy fibers are available, for example, from Johnson Matthey Company (West Whiteland, Pa.).

In some embodiments the ceramic fibers are in tows. Tows are known in the fiber art and refer to a plurality of (individual) fibers (typically at least 100 fibers, more typically at least 400 fibers) collected in a roving-like form. In some embodiments, tows comprise at least 780 individual fibers per tow, in some cases at least 2600 individual fibers per tow, and in other cases at least 5200 individual fibers per tow. Tows of ceramic fibers are generally available in a variety of lengths, including 300 meters, 500 meters, 750 meters, 1000 meters, 1500 meters, 2500 meters, 5000 meters, 7500 meters, and longer. The fibers may have a cross-sectional shape that is circular or elliptical.

Commercially available fibers may typically include an organic sizing material added to the fiber during manufacture to provide lubricity and to protect the fiber strands during handling. The sizing may be removed, for example, by dissolving or burning the sizing away from the fibers. Typically, it is desirable to remove the sizing before forming metal matrix composite wire. The fibers may also have coatings used, for example, to enhance the wettability of the fibers, to reduce or prevent reaction between the fibers and molten metal matrix material. Such coatings and techniques for providing such coatings are known in the fiber and composite art.

In further exemplary embodiments, each of the composite wires is selected from a metal matrix composite wire and a polymer composite wire. Suitable composite wires are disclosed, for example, in U.S. Pat. Nos. 6,180,232; 6,245,425; 6,329,056; 6,336,495; 6,344,270; 6,447,927; 6,460,597; 6,544,645; 6,559,385, 6,723,451; and 7,093,416.

One presently preferred fiber reinforced metal matrix composite wire is a ceramic fiber reinforced aluminum matrix composite wire. The ceramic fiber reinforced aluminum matrix composite wires preferably comprise continuous fibers of polycrystalline $\alpha$-$Al_2O_3$ encapsulated within a matrix of either substantially pure elemental aluminum or an alloy of pure aluminum with up to about 2% by weight copper, based on the total weight of the matrix. The preferred fibers comprise equiaxed grains of less than about 100 nm in size, and a fiber diameter in the range of about 1-50 micrometers. A fiber diameter in the range of about 5-25 micrometers is preferred with a range of about 5-15 micrometers being most preferred.

Preferred fiber reinforced composite wires to the present disclosure have a fiber density of between about 3.90-3.95 grams per cubic centimeter. Among the preferred fibers are those described in U.S. Pat. No. 4,954,462 (Wood et al., assigned to Minnesota Mining and Manufacturing Company, St. Paul, Minn.). Preferred fibers are available commercially under the trade designation "NEXTEL 610" alpha alumina based fibers (available from 3M Company, St. Paul, Minn.). The encapsulating matrix is selected to be such that it does not significantly react chemically with the fiber material (i.e., is relatively chemically inert with respect the fiber material, thereby eliminating the need to provide a protective coating on the fiber exterior.

In certain presently preferred embodiments of a composite wire, the use of a matrix comprising either substantially pure elemental aluminum, or an alloy of elemental aluminum with up to about 2% by weight copper, based on the total weight of the matrix, has been shown to produce successful wires. As used herein the terms "substantially pure elemental aluminum", "pure aluminum" and "elemental aluminum" are interchangeable and are intended to mean aluminum containing less than about 0.05% by weight impurities.

In one presently preferred embodiment, the composite wires comprise between about 30-70% by volume polycrystalline $\alpha$-$Al_2O_3$ fibers, based on the total volume of the composite wire, within a substantially elemental aluminum matrix. It is presently preferred that the matrix contains less than about 0.03% by weight iron, and most preferably less than about 0.01% by weight iron, based on the total weight of the matrix. A fiber content of between about 40-60% polycrystalline $\alpha$-$Al_2O_3$ fibers is preferred. Such composite wires, formed with a matrix having a yield strength of less than about 20 MPa and fibers having a longitudinal tensile strength of at least about 2.8 GPa have been found to have excellent strength characteristics.

The matrix may also be formed from an alloy of elemental aluminum with up to about 2% by weight copper, based on the total weight of the matrix. As in the embodiment in which a substantially pure elemental aluminum matrix is used, composite wires having an aluminum/copper alloy matrix preferably comprise between about 30-70% by volume polycrystalline $\alpha$-$Al_2O_3$ fibers, and more preferably therefore about 40-60% by volume polycrystalline $\alpha$-$Al_2O_3$ fibers, based on the total volume of the composite. In addition, the matrix preferably contains less than about 0.03% by weight iron, and most preferably less than about 0.01% by weight iron based on the total weight of the matrix. The aluminum/copper matrix preferably has a yield strength of less than about 90 MPa, and, as above, the polycrystalline $\alpha$-$Al_2O_3$ fibers have a longitudinal tensile strength of at least about 2.8 GPa.

Composite wires preferably are formed from substantially continuous polycrystalline $\alpha$-$Al_2O_3$ fibers contained within the substantially pure elemental aluminum matrix or the matrix formed from the alloy of elemental aluminum and up to about 2% by weight copper described above. Such wires are made generally by a process in which a spool of substantially continuous polycrystalline $\alpha$-$Al_2O_3$ fibers, arranged in a fiber tow, is pulled through a bath of molten matrix material. The resulting segment is then solidified, thereby providing fibers encapsulated within the matrix.

Exemplary metal matrix materials include aluminum (e.g., high purity, (e.g., greater than 99.95%) elemental aluminum, zinc, tin, magnesium, and alloys thereof (e.g., an alloy of aluminum and copper). Typically, the matrix material is selected such that the matrix material does not significantly chemically react with the fiber (i.e., is relatively chemically inert with respect to fiber material), for example, to eliminate the need to provide a protective coating on the fiber exterior. In some embodiments, the matrix material desirably includes aluminum and alloys thereof.

In some embodiments, the metal matrix comprises at least 98 percent by weight aluminum, at least 99 percent by weight aluminum, greater than 99.9 percent by weight aluminum, or even greater than 99.95 percent by weight aluminum. Exemplary aluminum alloys of aluminum and copper comprise at least 98 percent by weight Al and up to 2 percent by weight Cu. In some embodiments, useful alloys are 1000, 2000, 3000, 4000, 5000, 6000, 7000 and/or 8000 series aluminum alloys (Aluminum Association designations). Although higher purity metals tend to be desirable for making higher tensile strength wires, less pure forms of metals are also useful.

Suitable metals are commercially available. For example, aluminum is available under the trade designation "SUPER PURE ALUMINUM; 99.99% Al" from Alcoa of Pittsburgh, Pa. Aluminum alloys (e.g., Al-2% by weight Cu (0.03% by weight impurities)) can be obtained, for example, from Belmont Metals, New York, N.Y. Zinc and tin are available, for example, from Metal Services, St. Paul, Minn. ("pure zinc"; 99.999% purity and "pure tin"; 99.95% purity). For example, magnesium is available under the trade designation "PURE" from Magnesium Elektron, Manchester, England. Magnesium alloys (e.g., WE43A, EZ33A, AZ81A, and ZE41A) can be obtained, for example, from TIMET, Denver, Colo.

The metal matrix composite wires typically comprise at least 15 percent by volume (in some embodiments, at least 20, 25, 30, 35, 40, 45, or even 50 percent by volume) of the fibers, based on the total combined volume of the fibers and matrix material. More typically the composite cores and wires comprise in the range from 40 to 75 (in some embodiments, 45 to 70) percent by volume of the fibers, based on the total combined volume of the fibers and matrix material.

Metal matrix composite wires can be made using techniques known in the art. Continuous metal matrix composite wire can be made, for example, by continuous metal matrix infiltration processes. One suitable process is described, for example, in U.S. Pat. No. 6,485,796 (Carpenter et al.). Wires comprising polymers and fiber may be made by pultrusion processes which are known in the art.

In additional exemplary embodiments, the composite wires are selected to include polymer composite wires. The polymer composite wires comprise at least one continuous fiber in a polymer matrix. In some exemplary embodiments, the at least one continuous fiber comprises metal, carbon, ceramic, glass, and combinations thereof. In certain presently preferred embodiments, the at least one continuous fiber comprises titanium, tungsten, boron, shape memory alloy, carbon nanotubes, graphite, silicon carbide, boron, poly(aramid), poly(p-phenylene-2,6-benzobisoxazole)3, and combinations thereof. In additional presently preferred embodiments, the polymer matrix comprises a (co)polymer selected from an epoxy, an ester, a vinyl ester, a polyimide, a polyester, a cyanate ester, a phenolic resin, a bis-maleimide resin, and combinations thereof.

In any of the presently disclosed embodiments, one or more of the composite wires in a composite cable may advantageously be selected to be a metal clad composite wire. In certain exemplary embodiments, all of the composite wires are surrounded by a metal cladding, that is, a layer of ductile metal or ductile metal alloy, such as copper or a copper alloy, surrounding every composite wire in the composite cable. In some exemplary embodiments, each individual composite wire is individually surrounded by a metal cladding such that the metal cladding substantially contacts the entire exterior surface of the composite wire. Suitable metal clad composite wires are disclosed, for example, in U.S. Pat. No. 7,131,308.

Ductile metal wires for stranding around a composite core to provide a composite cable, e.g., an electrical power transmission cable according to certain embodiments of the present disclosure, are known in the art. Preferred ductile metals include iron, steel, zirconium, copper, tin, cadmium, aluminum, manganese, and zinc; their alloys with other metals and/or silicon; and the like. Copper wires are commercially available, for example from Southwire Company, Carrolton, Ga. Aluminum wires are commercially available, for example from Nexans, Weyburn, Canada or Southwire Company, Carrolton, Ga. under the trade designations "1350-H19 ALUMINUM" and "1350-HO ALUMINUM".

Typically, copper wires have a thermal expansion coefficient in a range from about 12 ppm/° C. to about 18 ppm/° C. over at least a temperature range from about 20° C. to about 800° C. Copper alloy (e.g., copper bronzes such as Cu—Si—X, Cu—Al—X, Cu—Sn—X, Cu—Cd; where X=Fe, Mn, Zn, Sn and or Si; commercially available, for example from Southwire Company, Carrolton, Ga.; oxide dispersion strengthened copper available, for example, from OMG Americas Corporation, Research Triangle Park, N.C., under the designation "GLIDCOP") wires. In some embodiments, copper alloy wires have a thermal expansion coefficient in a range from about 10 ppm/° C. to about 25 ppm/° C. over at least a temperature range from about 20° C. to about 800° C. The wires may be in any of a variety shapes (e.g., circular, elliptical, and trapezoidal).

Typically, aluminum wire have a thermal expansion coefficient in a range from about 20 ppm/° C. to about 25 ppm/° C. over at least a temperature range from about 20° C. to about 500° C. In some embodiments, aluminum wires (e.g., "1350-H19 ALUMINUM") have a tensile breaking strength, at least 138 MPa (20 ksi), at least 158 MPa (23 ksi), at least 172 MPa (25 ksi) or at least 186 MPa (27 ksi) or at least 200 MPa (29 ksi). In some embodiments, aluminum wires (e.g., "1350-HO ALUMINUM") have a tensile breaking strength greater than 41 MPa (6 ksi) to no greater than 97 MPa (14 ksi), or even no greater than 83 MPa (12 ksi).

Aluminum alloy wires are commercially available, for example, aluminum-zirconium alloy wires sold under the trade designations "ZTAL," "XTAL," and "KTAL" (available from Sumitomo Electric Industries, Osaka, Japan), or "6201" (available from Southwire Company, Carrolton, Ga.). In some embodiments, aluminum alloy wires have a thermal expansion coefficient in a range from about 20 ppm/° C. to about 25 ppm/° C. over at least a temperature range from about 20° C. to about 500° C.

The weight percentage of composite wires within the submersible composite cable will depend upon the design of the submersible cable and the conditions of its intended use.

In most applications in which the stranded composite cable is to be used as a component in a submersible composite cable, it is preferred that the stranded cable be free of electrical power conductor layers around the plurality of composite cables. In certain presently preferred embodiments, the submersible composite cable exhibits a strain to break limit of at least 0.5%.

The present disclosure is preferably carried out so as to provide very long submersible composite cables. It is also preferable that the composite wires within the stranded composite cable 10 themselves are continuous throughout the length of the stranded cable. In one preferred embodiment, the composite wires are substantially continuous and at least 150 meters long. More preferably, the composite wires are continuous and at least 250 meters long, more preferably at least 500 meters, still more preferably at least 750 meters, and most preferably at least 1000 meters long in the stranded composite cable 10.

In another aspect, the present disclosure provides a method of making a submersible composite cable, comprising (a) providing a non-composite electrically conductive core cable; (b) arranging a plurality of composite cables around the core cable, wherein the composite cables comprise a plurality of composite wires; and (c) surrounding the plurality of composite cables with a sheath, preferably an insulative sheath.

In yet another aspect, the present disclosure provides a method of making a submersible composite cable as described above, comprising (a) providing an electrically conductive core cable; (b) arranging a plurality of elements around the core cable in at least one cylindrical layer defined about a center longitudinal axis of the core cable when viewed in a radial cross section, wherein each element is selected from the group consisting of a fluid transport element, an electrical power transmission element, an electrical signal transmission element, a light transmission element, a weight element, a buoyancy element, a filler element, or an armor element; (c) surrounding the plurality of elements with a plurality of composite wires arranged in at least one cylindrical layer about the center longitudinal axis of the core cable; and (d) surrounding the plurality of composite wires with an insulative sheath.

In an additional aspect, the disclosure provides a method of making the stranded composite cables described above, the method comprising stranding a first plurality of composite wires about a single wire defining a center longitudinal axis, wherein stranding the first plurality of composite wires is carried out in a first lay direction at a first lay angle defined relative to the center longitudinal axis, and wherein the first plurality of composite wires has a first lay length; and stranding a second plurality of composite wires around the first plurality of composite wires, wherein stranding the second plurality of composite wires is carried out in the first lay direction at a second lay angle defined relative to the center longitudinal axis, and wherein the second plurality of composite wires has a second lay length, further wherein a relative difference between the first lay angle and the second lay angle is no greater than 4°. In one presently preferred embodiment, the method further comprises stranding a plurality of ductile wires around the composite wires.

The composite wires may be stranded or helically wound as is known in the art on any suitable cable stranding equipment, such as planetary cable stranders available from Cortinovis, Spa, of Bergamo, Italy, and from Watson Machinery International, of Patterson, N.J. In some embodiments, it may be advantageous to employ a rigid strander as is known in the art.

While any suitably-sized composite wire can be used, it is preferred for many embodiments and many applications that the composite wires have a diameter from 1 mm to 4 mm, however larger or smaller composite wires can be used.

In one preferred embodiment, the stranded composite cable includes a plurality of stranded composite wires that are helically stranded in a lay direction to have a lay factor of from 10 to 150. The "lay factor" of a stranded cable is determined by dividing the length of the stranded cable in which a single wire completes one helical revolution by the nominal outside of diameter of the layer that includes that strand.

During the cable stranding process, the center wire, or the intermediate unfinished stranded composite cable which will have one or more additional layers wound about it, is pulled through the center of the various carriages, with each carriage adding one layer to the stranded cable. The individual wires to be added as one layer are simultaneously pulled from their respective bobbins while being rotated about the center axis of the cable by the motor driven carriage. This is done in sequence for each desired layer. The result is a helically stranded core. Optionally, a maintaining means, such as a tape as described above, for example, can be applied to the resulting stranded composite core to aid in holding the stranded wires together.

In general, stranded composite cables according to the present disclosure can be made by stranding composite wires around a single wire in the same lay direction, as described above. The single wire may comprise a composite wire or a ductile wire. At least two layers of composite wires are formed by stranding composite wires about the single wire core, for example, 19 or 37 wires formed in at least two layers around a single center wire.

In some exemplary embodiments, stranded composite cables comprise stranded composite wires having a length of at least 100 meters, at least 200 meters, at least 300 meters, at least 400 meters, at least 500 meters, at least 1000 meters, at least 2000 meters, at least 3000 meters, or even at least 4500 meters or more.

The ability to handle the stranded cable is a desirable feature. Although not wanting to be bound by theory, the cable maintains its helically stranded arrangement because during manufacture, the metallic wires are subjected to stresses, including bending stresses, beyond the yield stress of the wire material but below the ultimate or failure stress. This stress is imparted as the wire is helically wound about the relatively small radius of the preceding layer or center wire. Additional stresses are imparted by closing dies which apply radial and shear forces to the cable during manufacture. The wires therefore plastically deform and maintain their helically stranded shape.

In some embodiments, techniques known in the art for straightening the cable may be desirable. For example, the finished cable can be passed through a straightener device comprised of rollers (each roller being for example, 10-15 cm (4-6 inches), linearly arranged in two banks, with, for example, 5-9 rollers in each bank. The distance between the two banks of rollers may be varied so that the rollers just impinge on the cable or cause severe flexing of the cable. The two banks of rollers are positioned on opposing sides of the cable, with the rollers in one bank matching up with the spaces created by the opposing rollers in the other bank. Thus, the two banks can be offset from each other. As the cable passes through the straightening device, the cable flexes back and forth over the rollers, allowing the strands in the conductor to stretch to the same length, thereby reducing or eliminating slack strands.

In some embodiments, it may be desirable to provide the single center wire at an elevated temperature (e.g., at least 25° C., 50° C., 75° C., 100° C., 125° C., 150° C., 200° C., 250° C., 300° C., 400° C., or even, in some embodiments, at least 500° C.) above ambient temperature (e.g., 22° C.). The single center wire can be brought to the desired temperature, for example, by heating spooled wire (e.g., in an oven for several hours). The heated spooled wire is placed on the pay-off spool of a stranding machine. Desirably, the spool at elevated temperature is in the stranding process while the wire is still at or near the desired temperature (typically within about 2 hours).

Further it may be desirable, for the composite wires on the payoff spools that form the outer layers of the cable, to be at the ambient temperature. That is, in some embodiments, it may be desirable to have a temperature differential between the single wire and the composite wires which form the outer composite layers during the stranding process. In some embodiments, it may be desirable to conduct the stranding with a single wire tension of at least 100 kg, 200 kg, 500 kg, 1000 kg., or even at least 5000 kg.

The operation of the present disclosure will be further described with regard to the following detailed examples. These examples are offered to further illustrate the various specific and preferred embodiments and techniques. It should be understood, however, that many variations and modifications may be made while remaining within the scope of the present disclosure.

EXAMPLES

The following materials were used in the following Comparative Examples and Examples:

NEXTEL 610, alpha alumina ceramic fibers (3M Company, St. Paul, Minn.);

AMC30, an aluminum matrix composite wire comprising 30% by weight NEXTEL 610 fibers, and 70% by weight aluminum (3M Company, St. Paul, Minn.);

AMC50 an aluminum matrix composite wire comprising 50% by weight NEXTEL 610 fibers, and 70% by weight aluminum (3M Company, St. Paul, Minn.);

KEVLAR 49, poly(aramid) fibers (E.I. DuPont de Nemours, Inc., Wilmington, Del.).

Figure 7:
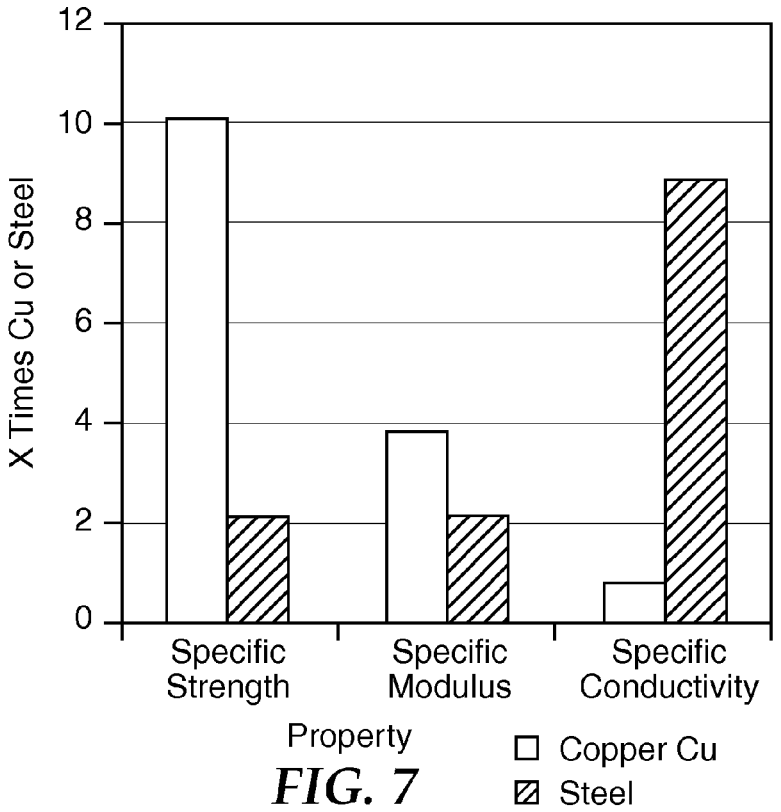
FIG. 7 is a chart comparing the relative strength, modulus and electrical conductivity of exemplary submersible composite power cables using composite conductors of the present disclosure, to corresponding submersible cables using copper or steel conductors Like reference numerals in the drawings indicate like elements. The drawings herein as not to scale, and in the drawings, the components of the composite cables are sized to emphasize selected features.

FIG. 7 illustrates the superior characteristics of an exemplary composite conductor wire relative to copper or steel conductor wires with respect to the specific strength, specific modulus, and specific (electrical) conductivity of the wire. Each property is expressed on a per unit weight basis. The values reported in FIG. 7 represent the specific property value for the composite conductor wire, divided by the specific property value for copper or steel, respectively. The composite conductor wire exhibits about ten times the specific strength as copper (two times that of steel); about four times the specific modulus of copper (about two times that of steel); and about nine times the specific (electrical) conductivity of steel (about the same as that of copper). The specific property data in FIG. 7 were used to calculate relative specific property values of submersible composite cables in which copper conductor wires and/or steel armor wires were replaced by composite conductor wires.

Table I summarizes cable properties for exemplary composite cables according to the present disclosure and a comparative example of a non-composite cable.

TABLE I

| Cable Property | Comparative Example 1 | Example 1 | Example 2 | Example 3 |
|---|---|---|---|---|
| Core Conductor Cable: | 12 × 10 $mm^2$ Cu | 12 × 10 $mm^2$ Cu | 12 × AMC30 | 12 × AMC50 |
| Conductors Around Core Cable: | 21 × 6 $mm^2$ Cu | 21 × 6 $mm^2$ Cu | 21 AMC30 | 21 AMC50 |
| Surrounding Armor Element: | KEVLAR 49 Fiber Layer | NEXTEL 610 Fiber Layer | None | None |
| Conductor Diameter (mm): | 60.3 | 60.3 | 63.3 | 62.6 |
| Cable Weight in Air (kg/m): | 5.357 | 6.030 | 5.038 | 5.091 |
| Cable Weight in Seawater (kg/m): | 2.829 | 3.502 | 2.258 | 2.379 |
| Cable Breaking Strength (daN): | 75,741 | 71,204 | 177,323 | 190,884 |
| Maximum Working Load @ 0.4% Strain (daN): | 15,882 | 30,567 | 38,733 | 61,330 |
| Percent of Comparative Example 1 (%): | 100% | 193% | 244% | 386% |
| Maximum Working Depth (m): | 5,725 | 8,901 | 17,494 | 26,284 |
| Percent of Comparative Example 1 (%): | 100% | 155% | 306% | 459% |
| Electrical Conductor Resistance (ohms/km): | 0.0701 | 0.0701 | 0.0472 | 0.0708 |
| Percent of Comparative Example 1 (%): | 100% | 100% | 148% | 99% |

Comparative Example 1 corresponds to a cable with only copper conductors and a single KEVLAR 49 fiber layer armor element. Example 1 corresponds to an exemplary embodiment of an armored submersible composite cable according to the present disclosure in which the copper conductors are retained, but in which a plurality of NEXTEL 610 ceramic fibers is used as an armor element surrounding the copper conductors. Examples 2-3 correspond to exemplary embodiments of unarmored submersible composite cables according to the present disclosure in which the copper conductors were replaced by AMC30 and AMC50 composite wire cables, respectively. AMC 30 is an aluminum matrix composite cable comprising ceramic fibers in a (cross-sectional) area fraction of 30%; AMC 50 is an aluminum matrix composite cable comprising ceramic fibers in a (cross-sectional) area fraction of 50%.

Table II summarizes cable properties for additional exemplary composite cables according to the present disclosure and an additional non-composite comparative example.

TABLE II

| Cable Property | Comparative Example 2 | Example 4 | Example 5 | Example 6 |
|---|---|---|---|---|
| Core Conductor Cable: | 14 × 4 $mm^2$ Cu | 14 × AMC50 | 10 × AMC50 | 8 × AMC50 |
| Surrounding Armor Element: | 3 Layers Steel Wire Armor (1.8 mm Inner, 1.8 mm Middle, 2.3 mm Outer) | 2 Layers AMC50 (Inner, Middle), 1 Layer Steel Wire Armor (2.3 mm Outer) | 1 Layer Steel Wire Armor (2.3 mm Outer) | None |
| Conductor Diameter (mm) | 41.2 | 41.2 | 40.0 | 39.5 |
| Conductor Area ($mm^2$): | 4 | 4 | 19 | 35 |
| Cable Weight in Air (kg/m): | 4.961 | 3.818 | 3.137 | 2.184 |
| Cable Weight in Seawater (kg/m): | 3.990 | 2.847 | 2.113 | 0.911 |
| Cable Breaking Strength (daN): | 51,691 | 50,191 | 42,030 | 32,621 |
| Maximum Working Load @ 0.4% Strain (daN): | 12,951 | 12,205 | 18,781 | 20,451 |
| Percent of Comparative Example 2 (%): | 100% | 94% | 145% | 158% |
| Maximum Working Depth @ 0.4% Strain (m): | 3,310 | 4,370 | 9,063 | 22,884 |
| Percent of Comparative Example 2 (%): | 100% | 132% | 274% | 691% |
| Maximum Working Load @ 25% Relative Breaking Strength (daN): | 12,923 | 12,548 | 10,507 | 8,155 |
| Percent of Comparative Example 2 (%): | 100% | 97% | 81% | 63% |
| Maximum Working Depth @ 25% Relative Breaking Strength (m): | 3,302 | 4,493 | 5,070 | 9,126 |
| Percent of Comparative Example 2 (%): | 100% | 136% | 153% | 276% |
| Electrical Conductor Resistance (ohms/km): | 0.3079 | 0.3079 | 0.3085 | 0.2073 |
| Percent of Comparative Example 2 (%): | 100% | 100% | 100% | 99% |

Comparative Example 2 corresponds to a cable with only copper conductors and 3 layers of steel wire armor elements as described in Table II. Examples 4-5 correspond to exemplary embodiments of armored submersible composite cables according to the present disclosure in which the copper conductors were replaced by AMC50 composite wire cables, and in which either two layers of AMC50 composite wire is used as an armor element in conjunction with an outer layer of steel wire armor (Example 4), or in which one layer of AMC50 composite wire is used as an armor element in conjunction with an outer layer of steel wire armor (Example 5). Example 6 corresponds to an exemplary embodiment of an unarmored submersible composite cable according to the present disclosure in which the copper conductors were replaced by AMC50 composite wires.

As illustrated by Tables I and II, exemplary embodiments of submersible composite cables according to the present disclosure have various features and characteristics that enable their use and provide advantages in a variety of applications. In addition, submersible composite cables according to some exemplary embodiments of the present disclosure may exhibit improved performance due to improved material properties including, low density, high modulus, high strength, fatigue resistance and conductivity.

Thus, the Examples and Comparative Examples demonstrate that exemplary submersible composite cables may exhibit greatly increased maximum working depth, maximum working load, and breaking strength, with greater or at least comparable electrical power transfer capabilities, compared to existing non-composite cables. Furthermore, exemplary embodiments of submersible composite cables according to the present disclosure may be lighter in weight in seawater compared to non-composite submersible cables, and therefore more readily deployed to, and recovered from, the seabed.

The fatigue resistance of the submersible composite cables may also be improved relative to non-composite cables. Umbilical cables are hoisted frequently over a life time of five years or more, passing through a series of sheaves each time the cable is hoisted. This creates very high tensile and bending loads at the sheaves where tension is at a maximum due to supporting entire cable weight. Additional dynamic bending loads occur from vertical and horizontal bobbing of the platform due to ocean waves. Composite cables may thus provide for improved fatigue resistance compared to non-composite cables.

In other exemplary embodiments, submersible composite cables according to the present disclosure may exhibit a reduced tendency to undergo premature fracture or failure at lower values of cable tensile strain during manufacture or use, when compared to other composite cables. In some particular exemplary embodiments, submersible composite cables incorporating stranded composite cables made according to embodiments of the present disclosure may exhibit an increase in tensile strength of 10% or greater compared to prior art cables. In some embodiments, the submersible composite cables provide for improved performance due to improved material properties including, for example, low density, high modulus, high strength, greater fatigue resistance and greater electrical conductivity per unit length.

In additional exemplary embodiments, incorporating stranded composite cables made according to the present disclosure into a submersible composite cable may provide improved corrosion resistance, environmental endurance (e.g., UV and moisture resistance), resistance to loss of strength at elevated temperatures, creep resistance, as well as relatively high elastic modulus, low density, low coefficient of thermal expansion, high electrical conductivity, high sag resistance, and high strength, when compared to conventional stranded ductile metal wire cables.

Submersible composite power transmission cables incorporating stranded composite cables manufactured according to certain embodiments of the present disclosure may also be made at a lower manufacturing cost due to an increase in yield from the stranding process of cable meeting the minimum tensile strength requirements for use in certain critical applications, for example, use in submersible electrical power transmission applications.

Reference throughout this specification to "one embodiment," "certain embodiments," "one or more embodiments" or "an embodiment," whether or not including the term "exemplary" preceding the term "embodiment," means that a particular feature, structure, material, or characteristic described in connection with the embodiment is included in at least one embodiment of the certain exemplary embodiments of the present disclosure. Thus, the appearances of the phrases such as "in one or more embodiments," "in certain embodiments," "in one embodiment" or "in an embodiment" in various places throughout this specification are not necessarily referring to the same embodiment of the certain exemplary embodiments of the present disclosure. Furthermore, the particular features, structures, materials, or characteristics may be combined in any suitable manner in one or more embodiments.

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. In particular, as used herein, the recitation of numerical ranges by endpoints is intended to include all numbers subsumed within that range (e.g., 1 to 5 includes 1, 1.5, 2, 2.75, 3, 3.80, 4, and 5). In addition, all numbers used herein are assumed to be modified by the term 'about'.

Furthermore, all publications and patents referenced herein are incorporated by reference in their entirety to the same extent as if each individual publication or patent was specifically and individually indicated to be incorporated by reference. Various exemplary embodiments have been described. These and other embodiments are within the scope of the following claims.

The invention claimed is:

1. A submersible composite cable, comprising:

a non-composite electrically conductive core cable;

a plurality of composite cables around the core cable, wherein the composite cables comprise a plurality of composite wires; and an insulative sheath surrounding the plurality of composite cables;

wherein each of the composite wires is a fiber reinforced composite wire.

2. The submersible composite cable of claim 1, further comprising a second plurality of composite wires, wherein at least a portion of the second plurality of composite wires is arranged around the plurality of composite cables in at least one cylindrical layer defined about a center longitudinal axis of the core cable when viewed in a radial cross section.

3. The submersible composite cable of claim 1, further comprising at least one element selected from the group consisting of a fluid transport element, an electrical power transmission element, an electrical signal transmission element, a light transmission element, a weight element, a buoyancy element, a filler element, or an armor element.

4. The submersible composite cable of claim 1, wherein the core cable comprises at least one metal wire, one metal load carrying element, or a combination thereof.

5. The submersible composite cable of claim 1, wherein the core cable comprises a plurality of metal wires, and wherein each of the plurality of metal wires, when viewed in a radial cross section, has a cross-sectional shape selected from the group consisting of circular, elliptical, trapezoidal, S-shaped, and Z-shaped.

6. The submersible composite cable of claim 1, wherein the plurality of composite cables around the core cable is arranged in at least two cylindrical layers defined about a center longitudinal axis of the core cable when viewed in a radial cross section.

7. The submersible composite cable of claim 6, wherein at least one of the at least two cylindrical layers comprises only the composite cables.

8. The submersible composite cable of claim 6, wherein at least one of the at least two cylindrical layers further comprises at least one element selected from the group consisting of a fluid transport element, a power transmission element, a light transmission element, a weight element, a filler element, or an armor element.

9. The submersible composite cable of claim 1, wherein at least one of the composite cables is a stranded composite cable comprising a plurality of cylindrical layers of the composite wires stranded about a center longitudinal axis of the at least one composite cable when viewed in a radial cross section.

10. The submersible composite cable of claim 9, wherein each cylindrical layer of the composite wires is helically stranded at a lay angle in a lay direction that is the same as a lay direction for each adjoining cylindrical layer.

11. The submersible composite cable of claim 10, wherein a relative difference between lay angles for each adjoining cylindrical layer is greater than 0° and no greater than 3°.

12. The submersible composite cable of claim 1, wherein the composite wires have a cross-sectional shape selected from the group consisting of circular, elliptical, and trapezoidal.

13. The submersible composite cable of claim 1, wherein each of the composite wires is selected from the group consisting of a metal matrix composite wire and a polymer composite wire.

14. The submersible composite cable of claim 13, wherein the polymer composite wire comprises at least one continuous fiber which comprises metal, carbon, ceramic, glass, or combinations thereof.

15. The submersible composite cable of claim 13, wherein the metal matrix composite wire comprises at least one continuous fiber which comprises a material selected from the group consisting of ceramics, glasses, carbon nanotubes, carbon, silicon carbide, boron, iron, steel, ferrous alloys, tungsten, titanium, shape memory alloy, and combinations thereof.

16. The submersible composite cable of claim 1, wherein the insulative sheath forms an outer surface of the submersible composite cable.

17. The submersible cable of claim 1, wherein the submersible cable exhibits a strain to break limit of at least 0.5%.

18. A method of making the submersible composite cable of claim 1, comprising:

providing a non-composite electrically conductive core cable;

arranging a plurality of composite cables around the core cable, wherein the composite cables comprise a plurality of composite wires; and surrounding the plurality of composite cables with an insulative sheath.

19. The submersible cable of claim 1, wherein at least one of the composite wires is a metal clad composite wire.

* * * * *